US010458069B2

(12) United States Patent
Maladen et al.

(10) Patent No.: US 10,458,069 B2
(45) **Date of Patent: *Oct. 29, 2019**

(54) FIBROUS STRUCTURES

(71) Applicant: The Procter & Gamble Company, Cincinnati, OH (US)

(72) Inventors: Ryan Dominic Maladen, AndersonTownship, OH (US); Jeffrey Glen Sheehan, Symmes Township, OH (US); Osman Polat, Montgomery, OH (US); Douglas Jay Barkey, Salem Township, OH (US)

(73) Assignee: The Procter & Gamble Compay, Cincinnati, OH (US)

( * ) Notice: Subject to any disclaimer, the term of this patent is extended or adjusted under 35 U.S.C. 154(b) by 98 days.

This patent is subject to a terminal disclaimer.

(21) Appl. No.: 15/493,336

(22) Filed: Apr. 21, 2017

(65) Prior Publication Data

US 2017/0218573 A1 Aug. 3, 2017

Related U.S. Application Data

(63) Continuation of application No. 14/642,870, filed on Mar. 10, 2015, now Pat. No. 10,132,042.
(Continued)

(51) Int. Cl.
*D21H 27/02* (2006.01)
*D21H 27/42* (2006.01)
(Continued)

(52) U.S. Cl.
CPC ..... *D21H 27/02* (2013.01); *D21H 25/005* (2013.01); *D21H 27/002* (2013.01);
(Continued)

(58) Field of Classification Search
None
See application file for complete search history.

(56) References Cited

U.S. PATENT DOCUMENTS

D3,406 S 3/1869 Bulton
D30,628 S 1/1899 Norman
(Continued)

FOREIGN PATENT DOCUMENTS

CA 40677 5/1976
CA 45803 8/1979
(Continued)

OTHER PUBLICATIONS

US 5,972,466 A, 10/1999, Trokhan (withdrawn)
(Continued)

*Primary Examiner* — Jacob T Minskey
(74) *Attorney, Agent, or Firm* — Andrew J. Mueller

(57) ABSTRACT

A fibrous structure is disclosed. The fibrous structure exhibits a plurality of discrete knuckles arranged in a pattern of repeat units. The repeat units can include a plurality of rows arranged orthogonally in an X-Y plane, each row having a portion of the discrete knuckles, and each discrete knuckle separated from adjacent discrete knuckles in a row by a distance. Each of the discrete knuckles within the repeat unit can have substantially the same shape and size; and wherein the distance between at least two adjacent discrete knuckles in each row are non-uniform such that the repeat unit exhibits varying pillow width distances along the rows in both the X and Y axes.

7 Claims, 13 Drawing Sheets

Related U.S. Application Data

(60) Provisional application No. 62/033,414, filed on Aug. 5, 2014.

(51) Int. Cl.
*D21H 27/00* (2006.01)
*D21H 27/40* (2006.01)
*D21H 25/00* (2006.01)
*D21H 27/32* (2006.01)

(52) U.S. Cl.
CPC ..... *D21H 27/005* (2013.01); *D21H 27/32* (2013.01); *D21H 27/40* (2013.01); *D21H 27/42* (2013.01)

(56) References Cited

U.S. PATENT DOCUMENTS

D36,460 S 7/1903 Henry
D38,211 S 8/1906 French
D58,840 S 8/1921 Thompson
D71,546 S 11/1926 Day
D88,182 S 11/1932 Weitz
D89,078 S 1/1933 Grulich
D96,576 S 8/1935 Haywood
D103,858 S 3/1937 Minoff
D116,385 S 8/1939 Sigoda
2,443,170 A 6/1948 Smith
D175,222 S 7/1955 Holt, Jr.
D176,223 S 11/1955 McCord
D177,059 S 3/1956 McCord
D182,816 S 5/1958 Hpbbs
3,239,065 A 3/1966 Hunt
3,301,746 A 1/1967 Sanford et al.
D207,397 S 4/1967 Hooton
3,323,983 A 6/1967 Palmer et al.
3,414,459 A 12/1968 Wells
3,473,576 A 10/1969 Amneus
3,556,932 A 1/1971 Coscia et al.
3,556,933 A 1/1971 Williams et al.
3,573,164 A 3/1971 Friedberg et al.
3,672,950 A 6/1972 Brown et al.
3,684,641 A 8/1972 Murphy
3,700,623 A 10/1972 Keim
3,772,076 A 11/1973 Keim
3,788,934 A 1/1974 Coppa
3,812,000 A 5/1974 Salvucci et al.
3,821,068 A 6/1974 Shaw
3,905,863 A 9/1975 Ayers
3,974,025 A 8/1976 Ayers
3,994,771 A 11/1976 Morgan, Jr. et al.
4,011,389 A 3/1977 Langdon
4,191,609 A 3/1980 Trokhan
4,191,756 A 3/1980 Masi et al.
4,208,459 A 6/1980 Becker et al.
4,239,065 A 12/1980 Trokhan
4,300,981 A 11/1981 Carstens
4,320,162 A 3/1982 Schulz et al.
4,367,859 A 1/1983 Lamon
D268,961 S 5/1983 Erickson
4,391,878 A 7/1983 Drach
4,440,597 A 4/1984 Wells et al.
4,514,345 A 4/1985 Johnson et al.
4,528,239 A 7/1985 Trokhan
4,557,801 A 12/1985 Avis
4,637,859 A 1/1987 Trokhan
D298,702 S 11/1988 Drew
4,894,726 A 1/1990 Steinhardt et al.
4,919,756 A 4/1990 Sawdai
D314,673 S 2/1991 Legare
5,059,282 A 10/1991 Ampulski et al.
5,098,522 A 3/1992 Smurkoski et al.
5,164,046 A 11/1992 Ampulski et al.
5,179,448 A 1/1993 Steinhardt et al.
5,221,435 A 6/1993 Smith, Jr.
5,245,025 A 9/1993 Torkhan et al.
5,246,545 A 9/1993 Ampulski et al.
5,246,546 A 9/1993 Ampulski
5,260,171 A 11/1993 Smurkoski et al.
5,275,700 A 1/1994 Trokhan
5,277,761 A 1/1994 Van Phan et al.
5,294,475 A 3/1994 Mcneil
5,328,565 A 7/1994 Rasch et al.
5,334,289 A 8/1994 Trokhan et al.
5,364,504 A 11/1994 Smurkoski et al.
5,411,636 A 5/1995 Hermans et al.
5,415,918 A 5/1995 Lang et al.
5,431,786 A 7/1995 Rasch et al.
5,436,057 A 7/1995 Schulz
5,443,691 A 8/1995 Phan et al.
D363,610 S 10/1995 Saffran et al.
5,468,323 A 11/1995 McNeil
5,496,624 A 3/1996 Stelljes, Jr. et al.
5,500,277 A 3/1996 Trokhan et al.
5,514,523 A 5/1996 Trokhan et al.
5,527,428 A 6/1996 Trokhan et al.
5,549,790 A 8/1996 Van Phan et al.
5,552,345 A 9/1996 Schrantz et al.
5,554,467 A 9/1996 Trokhan et al.
5,556,509 A 9/1996 Trokhan et al.
5,566,724 A 10/1996 Trokhan et al.
5,580,423 A 12/1996 Ampulski et al.
5,609,725 A 3/1997 Van Phan
5,624,790 A 4/1997 Trokhan et al.
5,628,876 A 5/1997 Ayers et al.
5,629,052 A 5/1997 Trokhan et al.
5,637,194 A 6/1997 Ampulski et al.
5,654,076 A 8/1997 Trokhan et al.
5,656,132 A 8/1997 Farrington, Jr. et al.
5,674,663 A 10/1997 McFarland et al.
5,679,222 A 10/1997 Rasch et al.
5,693,406 A 12/1997 Wegele et al.
5,709,775 A 1/1998 Trokhan et al.
5,714,041 A 2/1998 Ayers et al.
5,716,692 A 2/1998 Warner et al.
5,728,268 A 3/1998 Weisman et al.
5,795,440 A 8/1998 Ampulski et al.
5,804,281 A 9/1998 Phan et al.
5,820,730 A 10/1998 Phan et al.
5,830,558 A 11/1998 Barnholtz
5,840,403 A 11/1998 Trokhan et al.
5,840,411 A 11/1998 Stelljes, Jr. et al.
5,843,270 A 12/1998 Burgin
5,858,554 A 1/1999 Neal et al.
D405,270 S 2/1999 Horner-Long et al.
D405,271 S 2/1999 Unwin et al.
5,865,950 A 2/1999 Vinson et al.
D407,225 S 3/1999 Dwiggins et al.
5,855,739 A 3/1999 Dalal et al.
D409,389 S 5/1999 May et al.
5,900,122 A 5/1999 Huston
5,906,710 A 5/1999 Trokhan
5,906,711 A 5/1999 Barnholtz
D411,369 S 6/1999 Burr et al.
5,919,556 A 7/1999 Barnholtz
5,935,381 A 8/1999 Trokhan et al.
5,938,893 A 8/1999 Trokhan et al.
5,942,085 A 8/1999 Neal et al.
5,948,210 A 9/1999 Huston
D417,962 S 12/1999 Funk et al.
D426,709 S 1/2000 Latchoo et al.
D420,808 S 2/2000 Dwiggins et al.
6,030,690 A 2/2000 Mcneil et al.
6,039,839 A 3/2000 Trokhan et al.
D422,150 S 4/2000 Enderby
D423,232 S 4/2000 Reid
6,048,938 A 4/2000 Neal et al.
D426,303 S 6/2000 Weyenberg
D426,388 S 6/2000 Jahner et al.
D426,888 S 6/2000 Ilian
D427,778 S 7/2000 Durben et al.
6,086,715 A 7/2000 Mcneil
6,106,670 A 8/2000 Weisman et al.
6,113,723 A 9/2000 Mcneil et al.

(56) References Cited

U.S. PATENT DOCUMENTS 6,117,525 A 9/2000 Trokhan et al.
6,136,146 A 10/2000 Phan et al.
6,139,686 A 10/2000 Trokhan et al.
D433,572 S 11/2000 Bissah et al.
D433,820 S 11/2000 Haarer et al.
D434,913 S 12/2000 Schmidt et al.
6,165,319 A 12/2000 Heath et al.
D436,739 S 1/2001 Jahner et al.
6,171,447 B1 1/2001 Trokhan
D438,017 S 2/2001 Reid
6,187,138 B1 2/2001 Neal et al.
6,193,839 B1 2/2001 Ampulski et al.
6,193,847 B1 2/2001 Trokhan
D438,958 S 3/2001 Velazquez et al.
D438,960 S 3/2001 Velazquez et al.
D438,961 S 3/2001 Velazquez et al.
D438,963 S 3/2001 Velazquez et al.
6,200,419 B1 3/2001 Phan
6,238,682 B1 5/2001 Klofta et al.
6,277,466 B1 8/2001 McNeil et al.
D448,078 S 9/2001 Deoliveira et al.
D448,478 S 9/2001 Deoliveira et al.
D449,453 S 10/2001 Duritsch et al.
D449,935 S 11/2001 Cohen et al.
D449,936 S 11/2001 Cohen et al.
D450,191 S 11/2001 Cohen et al.
D450,934 S 11/2001 Duritsch et al.
6,348,131 B1 2/2002 Kershaw et al.
6,358,594 B1 3/2002 Ampulski
D462,180 S 9/2002 Kao et al.
D463,137 S 9/2002 Monroe et al.
D472,056 S 3/2003 Jahner
6,540,880 B1 4/2003 Trokhan et al.
6,547,928 B2 4/2003 Barnholtz et al.
6,548,447 B1 4/2003 Yokoyama et al.
6,551,453 B2 4/2003 Weisman et al.
D475,206 S 6/2003 Ackerman et al.
D476,161 S 6/2003 Salway et al.
6,602,577 B1 8/2003 Ostendorf et al.
6,610,173 B1 8/2003 Lindsay et al.
D482,784 S 11/2003 Babusik
6,660,129 B1 12/2003 Cabell et al.
6,673,202 B2 1/2004 Burazin et al.
6,675,429 B2 1/2004 Carter et al.
6,706,152 B2 3/2004 Burzain et al.
D488,810 S 4/2004 Lin et al.
6,746,570 B2 6/2004 Burzain et al.
6,746,766 B2 6/2004 Bond et al.
6,749,719 B2 6/2004 Burzain et al.
D493,622 S 8/2004 Hynnek et al.
6,787,000 B2 9/2004 Burzain et al.
6,797,114 B2 9/2004 Hu
6,802,937 B2 10/2004 Johnston et al.
6,821,385 B2 11/2004 Burzain et al.
6,821,386 B2 11/2004 Weisman et al.
D504,236 S 4/2005 Olson et al.
6,890,872 B2 5/2005 Bond et al.
D506,071 S 6/2005 Delaney
D507,117 S 7/2005 Delaney
6,946,506 B2 9/2005 Bond et al.
D518,298 S 4/2006 Hynnek et al.
7,022,395 B2 4/2006 Ackerman et al.
D519,739 S 5/2006 Schuh et al.
D520,249 S 5/2006 Hasenoehrl
D520,754 S 5/2006 Hasenoehrl
D526,129 S 10/2006 Delaney
7,128,809 B2 10/2006 Vinson et al.
7,169,458 B2 1/2007 Underhill et al.
D541,052 S 4/2007 Miller et al.
D544,215 S 6/2007 Enderby
D550,969 S 9/2007 Fung et al.
D550,970 S 9/2007 Vidal et al.
D555,908 S 11/2007 Johnsrud
7,311,800 B2 12/2007 Russel et al.
7,326,322 B2 2/2008 Ruthven et al.
7,419,569 B2 9/2008 Hermans et al.
7,494,563 B2 2/2009 Edwards et al.
7,494,564 B2 2/2009 Basler et al.
7,527,851 B2 5/2009 Schuh et al.
7,550,059 B2 6/2009 Van Phan et al.
7,687,140 B2 3/2010 Manifold et al.
7,691,229 B2 4/2010 Vinson et al.
7,704,601 B2 4/2010 Manifold et al.
7,744,723 B2 6/2010 Sheehan et al.
7,807,022 B2 10/2010 Hermans et al.
7,811,665 B2 10/2010 Manifold et al.
D634,130 S 3/2011 Coffaro et al.
D635,370 S 4/2011 Coffaro et al.
D636,609 S 4/2011 Coffaro et al.
D637,821 S 5/2011 Steeman et al.
D638,224 S 5/2011 Ko et al.
D638,630 S 5/2011 Coffaro et al.
7,939,168 B2 5/2011 Manifold et al.
7,960,020 B2 6/2011 Manifold et al.
8,025,966 B2 6/2011 Manifold et al.
7,989,058 B2 8/2011 Manifold et al.
D644,441 S 9/2011 Hutchison
D645,258 S 9/2011 Weber
D646,900 S 10/2011 Vitucci et al.
D647,310 S 10/2011 Hutchison
8,298,376 B2 10/2012 Polat et al.
8,313,617 B2 11/2012 Polat et al.
8,911,850 B2 12/2014 Kien et al.
2002/0168518 A1 11/2002 Bond et al.
2003/0072918 A1 4/2003 Anderson
2003/0077444 A1 4/2003 Bond et al.
2003/0092343 A1 5/2003 Bond et al.
2003/0138597 A1 7/2003 Ruthven et al.
2003/0168912 A1 9/2003 Wodrich et al.
2004/0009387 A1 1/2004 Aoki et al.
2004/0023003 A1 2/2004 Basler et al.
2004/0025887 A1 2/2004 Scopton
2004/0084167 A1 5/2004 Vinson et al.
2004/0112783 A1 6/2004 Mukai et al.
2004/0154767 A1 8/2004 Trokhan et al.
2004/0154768 A1 8/2004 Trokhan et al.
2004/0154769 A1 8/2004 Lorenz et al.
2004/0157524 A1 8/2004 Polat et al.
2004/0192136 A1 9/2004 Gusky et al.
2004/0258886 A1 12/2004 Macig
2004/0261639 A1 12/2004 Vaughn et al.
2005/0026529 A1 2/2005 Bond et al.
2005/0045293 A1 3/2005 Hermans et al.
2005/0067126 A1 3/2005 Horenziak et al.
2005/0079785 A1 4/2005 Bond et al.
2005/0178513 A1 8/2005 Russell et al.
2005/0201965 A1 9/2005 Kuhlman et al.
2006/0266484 A1 11/2006 Vinson et al.
2007/0062568 A1 3/2007 Harbaugh et al.
2007/0122595 A1 5/2007 Basler et al.
2007/0232178 A1 10/2007 Polat et al.
2007/0272381 A1 11/2007 Elony et al.
2008/0041543 A1 2/2008 Dyer et al.
2008/0260996 A1 10/2008 Heilman et al.
2008/0271863 A1 11/2008 Zoller et al.
2008/0294140 A1 11/2008 Ecker et al.
2009/0056891 A1 3/2009 Wiwi et al.
2009/0220741 A1 9/2009 Manifold et al.
2009/0220769 A1 9/2009 Manifold et al.
2009/0297775 A1 12/2009 Spitzer et al.
2010/0129681 A1 5/2010 Coderre
2010/0294446 A1 11/2010 Manifold et al.
2010/0297395 A1 11/2010 Mellin et al.
2011/0027563 A1 2/2011 Manifold et al.
2011/0183132 A1 7/2011 Manifold et al.
2011/0189435 A1 8/2011 Manifold et al.
2011/0189436 A1 8/2011 Manifold et al.
2011/0189442 A1 8/2011 Manifold et al.
2011/0189443 A1 8/2011 Manifold et al.
2011/0189451 A1 8/2011 Manifold et al.
2011/0206913 A1 8/2011 Manifold et al.
2011/0253329 A1 10/2011 Manifold et al.
2011/0305884 A1 12/2011 Manifold et al.
2012/0043036 A1 2/2012 Polat et al.

(56) References Cited

U.S. PATENT DOCUMENTS

| | | | |
|---|---|---|---|
| 2012/0043041 | A1 | 2/2012 | Polat et al. |
| 2012/0043042 | A1 | 2/2012 | Polat et al. |
| 2012/0180971 | A1 | 7/2012 | Polat et al. |
| 2013/0209749 | A1 | 8/2013 | Myangiro et al. |
| 2014/0138040 | A1 | 5/2014 | Sartini et al. |

FOREIGN PATENT DOCUMENTS

| | | | |
|---|---|---|---|
| CA | 66787 | | 9/1990 |
| CA | 80403 | | 1/1997 |
| CA | 84961 | | 10/1998 |
| CA | 84963 | | 10/1998 |
| CA | 88125 | | 11/1999 |
| CA | 88455 | | 12/1999 |
| CA | 88456 | | 12/1999 |
| CA | 90931 | | 11/2000 |
| CA | 91307 | | 1/2001 |
| CA | 2835873 | A1 | 5/2001 |
| CA | 92883 | | 7/2001 |
| CA | 94566 | | 1/2002 |
| CA | 96514 | | 3/2002 |
| CA | 95529 | | 10/2002 |
| CA | 100535 | | 8/2005 |
| EP | 0 617 164 | A1 | 9/1994 |
| EP | 0 677 612 | A2 | 10/1995 |
| EP | 0 617 164 | B1 | 8/1997 |
| EP | 1 876 291 | A2 | 1/2005 |
| EP | 1 505 207 | A2 | 2/2005 |
| EP | 0 677 612 | B2 | 6/2006 |
| EP | 2 048 283 | A1 | 4/2009 |
| FR | 2576328 | A1 | 7/1986 |
| GB | 2319539 | A | 5/1998 |
| WO | WO 96-00812 | A1 | 1/1996 |
| WO | WO 96-33310 | A1 | 10/1996 |
| WO | WO 09717494 | A1 | 5/1997 |
| WO | WO 98-44194 | A1 | 10/1998 |
| WO | WO 98-50481 | A1 | 11/1998 |
| WO | WO 98-50482 | A1 | 11/1998 |
| WO | WO 2004-056560 | A1 | 7/2004 |
| WO | WO 2005-021868 | A1 | 3/2005 |
| WO | WO 2005-068720 | A1 | 7/2005 |
| WO | WO 2005-080683 | A2 | 9/2005 |
| WO | WO 2006-060814 | A2 | 6/2006 |
| WO | WO 2007-001576 | A1 | 1/2007 |
| WO | WO 2007-070124 | A1 | 6/2007 |
| WO | WO 2008-051269 | A1 | 5/2008 |

OTHER PUBLICATIONS

Beyer, J., *Designing Tessellations: The Secrets of Interlocking Patterns*, pp. 10-30 (Contemporary Books, Chicago, IL 1999).

Bejan, A., "Constructal Theory of Pattern Formation," *Hydrology and Earth System Sciences*, vol. 11, Jan. 17, 2007, pp. 753-768.

El-Hosseiny, et al., "Effect of Fiber Length and Coarseness of the Burst Strength of Paper", TAPPI Journal, vol. 82: No. 1 (Jan. 1999), pp. 202-203.

Smook, Gary A., Second Edition Handbook for Pulp & Paper Technologists, 1992, Angus Wilde Publications, Chapter 13, pp. 194-208.

PCT International Search Report dated Oct. 16, 2015—5 pages.

PCT International Search Report dated Oct. 20, 2015—7 pages.

PCT International Search Report dated Oct. 16, 2015—4 pages.

PCT International Search Report dated Oct. 21, 2015—4 pages.

All Office Actions U.S. Appl. No. 14/642,856; U.S. Appl. No. 14/642,861; U.S. Appl. No. 14/642,867; and U.S. Appl. No. 14/642,870.

FIBROUS STRUCTURES

FIELD

The present disclosure generally relates to fibrous structures and, more particularly, relates to fibrous structures comprising discrete elements situated in irregular patterns.

BACKGROUND

Fibrous structures, such as sanitary tissue products, for example, are useful in many ways in everyday life. These products can be used as wiping implements for post-urinary and post-bowel movement cleaning (toilet tissue and wet wipes), for otorhinolaryngological discharges (facial tissue), and multi-functional absorbent and cleaning uses (paper towels).

Retail consumers fibrous structures such as paper towels and bath tissue look for certain properties, including softness, strength, and absorbency, for example. Such properties can be supplied in a fibrous structure by the selection of the material components of the fibrous structure and the manufacturing equipment and processes used to make it.

However, also important in today's retail environment is the appearance of a paper towel or bath tissue. That is, in addition to superior performance properties of a fibrous structure, retail consumers desire the product to be visually appealing. Thus, manufacturers of fibrous structures such as paper towels and bath tissue must produce products that both perform well, and have consumer-acceptable aesthetic qualities.

Often the two goals of superior product performance and desirable aesthetics are in contradiction to one another. For example, absorbency or strength in a paper towel can depend on processing parameters such as the structure of papermaking belts during paper making or the emboss pattern applied during converting operations. Both paper structures produced during papermaking and embossing can affect the physical properties of the finished product, but they also affect the visual, aesthetic properties. It can happen that a fibrous structure in the form of a paper towel, for example, can have superior absorbency properties in a visually unaesthetic manner.

Another problem with different physical properties into fibrous structures is that consumers of rolled tissue products, such as bathroom tissue and paper towels, generally prefer firm rolls. A firm roll conveys superior product quality and conveys sufficient fibrous structure material is present on the roll and consequently provides value for the consumer. A firm roll is one with a lower percent compressibility value. From the standpoint of a fibrous structure manufacturer, however, when making product property changes providing a firm roll or one with a low percent compressibility can be a challenge.

Further, in order to provide a target roll diameter, while maintaining an acceptable cost of manufacture, the fibrous structure manufacturer must produce a finished fibrous structure roll having higher roll bulk. One means of increasing roll bulk is to wind the fibrous structure roll loosely. Loosely wound rolls however, have low firmness or high compressibility and are easily deformed, which makes them unappealing to consumers. The fibrous structure manufacturer's challenge can be greater with certain physical properties of a fibrous structure, such as new surface topology in a single or multiply rolled tissue product. As such, there is a need for fibrous structure rolls having high bulk as well as good firmness (low percent compressibility) even after the fibrous structure has been modified with new physical properties of the finished fibrous structure product. Furthermore, it is desirable to provide a rolled tissue product with high roll bulk and low percent compressibility while comprising a high basis weight fibrous structure sheet spirally wound on the roll where the fibrous structure sheet provides greater absorbency, strength, and is aesthetically acceptable in use.

The existing art can be improved, and the consumer desired results can be achieved, by new fibrous structures that deliver both superior performance properties and consumer-desirable aesthetic properties.

Further, the existing art can be improved by new rolled tissue products that deliver superior performance properties and/or consumer-desirable aesthetic properties and can be converted to rolled tissue products having consumer-acceptable roll properties, such as roll bulk and percent compressibility.

SUMMARY

A fibrous structure is disclosed. The fibrous structure exhibits a plurality of discrete knuckles arranged in a pattern of repeat units. The repeat units can include a plurality of rows arranged orthogonally in an X-Y plane, each row having a portion of the discrete knuckles, and each discrete knuckle separated from adjacent discrete knuckles in a row by a distance. Each of the discrete knuckles within the repeat unit can have substantially the same shape and size; and wherein the distance between at least two adjacent discrete knuckles in each row are non-uniform such that the repeat unit exhibits varying pillow width distances along the rows in both the X and Y axes.

BRIEF DESCRIPTION OF THE DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION

Figure 1:
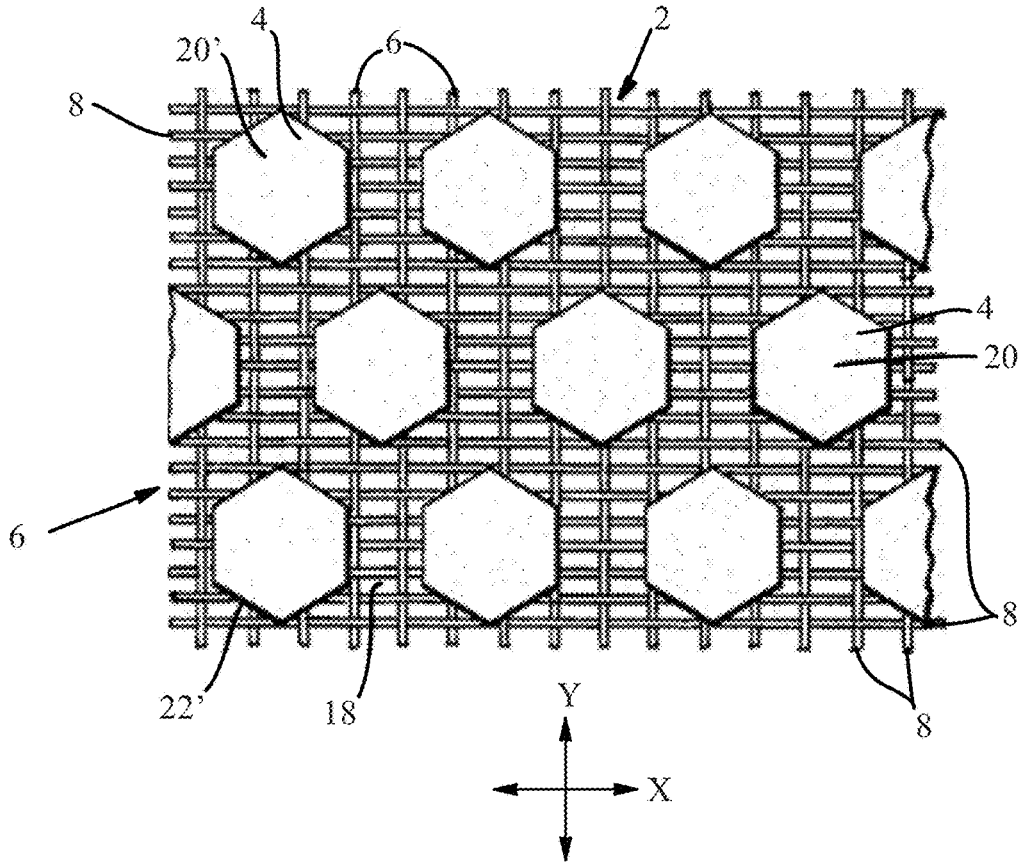
Fig. 1 PRIOR ART
FIG. 1 is a representative papermaking belt of the kind useful as a papermaking belt used in the present invention.

Various non-limiting embodiments of the present disclosure will now be described to provide an overall understanding of the principles of the structure, function, manufacture, and use of the fibrous structures disclosed herein. One or more examples of these non-limiting embodiments are illustrated in the accompanying drawings. Those of ordinary skill in the art will understand that the fibrous structures described herein and illustrated in the accompanying drawings are non-limiting example embodiments and that the scope of the various non-limiting embodiments of the present disclosure are defined solely by the claims. The features illustrated or described in connection with one non-limiting embodiment can be combined with the features of other non-limiting embodiments. Such modifications and variations are intended to be included within the scope of the present disclosure.

Fibrous structures such as sanitary tissue products, including paper towels, bath tissues and facial tissues are typically made in a "wet laying" process in which a slurry of fibers, usually wood pulp fibers, is deposited a onto a forming wire and/or one or more papermaking belts such that an embryonic fibrous structure can be formed, after which drying and/or bonding the fibers together results in a fibrous structure. Further processing the fibrous structure can be carried out such that a finished fibrous structure can be formed. For example, in typical papermaking processes, the finished fibrous structure is the fibrous structure that is wound on the reel at the end of papermaking, and can subsequently be converted into a finished product (e.g., a sanitary tissue product) by ply-bonding and embossing, for example.

The wet-laying process can be designed such that the finished fibrous structure has visually distinct features produced in the wet-laying process. Any of the various forming wires and papermaking belts utilized can be designed to leave a physical, three-dimensional impression in the finished paper. Such three-dimensional impressions are well known in the art, particularly in the art of "through air drying" (TAD) processes, with such impressions often being referred to a "knuckles" and "pillows." Knuckles are typically relatively high density regions corresponding to the "knuckles" of a papermaking belt, i.e., the filaments or resinous structures that are raised at a higher elevation than other portions of the belt. Likewise, "pillows" are typically relatively low density regions formed in the finished fibrous structure at the relatively uncompressed regions between or around knuckles. Further, the pillows in a fibrous structure can exhibit a range of densities relative to one another. A sanitary tissue product made with a TAD process is known in the art as "TAD paper," and is distinguished from "conventional paper."

Thus, in the description below, the term "knuckles" or "knuckle region," or the like can be used for either the raised portions of a papermaking belt or the densified, raised portions formed in the paper made on the papermaking belt, and the meaning should be clear from the context of the description herein. Likewise "pillow" or "pillow region" or the like can be used for either the portion of the papermaking belt between or around knuckles (also referred to herein and in the art as "deflection conduits" or "pockets"), or the relatively uncompressed regions between or around knuckles in the paper made on the papermaking belt, and the meaning should be clear from the context of the description herein. Knuckles or pillows can each be either continuous or discrete, as described herein.

Knuckles and pillows in paper towels and bath tissue can be visible to the retail consumer of such products. The knuckles and pillows can be imparted to a fibrous structure from a papermaking belt in various stages of production, i.e., at various consistencies and at various unit operations during the drying process, and the visual pattern generated by the pattern of knuckles and pillows can be designed for functional performance enhancement as well as to be visually appealing. Such patterns of knuckles and pillows can be made according to the methods and processes described in U.S. Pat. No. 6,610,173, issued to Lindsay et al. on Aug. 26, 2003, or U.S. Pat. No. 4,514,345 issued to Trokhan on Apr. 30, 1985, or U.S. Pat. No. 6,398,910 issued to Burazin et al. on Jun. 4, 2002, or US Pub. No. 2013/0199741; published in the name of Stage et al. on Aug. 8, 2013. The Lindsay, Trokhan, Burazin and Stage disclosures describe belts that are representative of papermaking belts made with cured resin on a woven reinforcing member, of which the present invention is an improvement. But further, the present improvement can be utilized as a fabric crepe belt as disclosed in U.S. Pat. No. 7,494,563, issued to Edwards et al. on Feb. 24, 2009 or U.S. Pat. No. 8,152,958, issued to Super et al. on Apr. 10, 2012, as well as belt crepe belts, as described in U.S. Pat. No. 8,293,072, issued to Super et al on Oct. 23, 2012. When utilized as a fabric crepe belt, a papermaking belt of the present invention can provide the relatively large recessed pockets and sufficient knuckle dimensions to redistribute the fiber upon high impact creping in a creping nip between a backing roll and the fabric to form additional bulk in conventional wet press processes. Likewise, when utilized as a belt in a belt crepe method, a papermaking belt of the present invention can provide the fiber enriched dome regions arranged in a repeating pattern corresponding to the pattern of the papermaking belt, as well as the interconnected plurality of surround areas to form additional bulk and local basis weight distribution in a conventional wet press process.

An example of a papermaking belt structure of the type useful in the present invention and made according to the disclosure of U.S. Pat. No. 4,514,345 is shown in FIG. 1. As shown, the papermaking belt 2 can include cured resin elements 4 forming knuckles 20 on a woven reinforcing member 6. The reinforcing member 6 can made of woven filaments 8 as is known in the art of papermaking belts, including resin coated papermaking belts. The papermaking belt structure shown in FIG. 1 includes discrete knuckles 20 and a continuous deflection conduit, or pillow region. The discrete knuckles 20 can form densified knuckles in the fibrous structure made thereon; and, likewise, the continuous deflection conduit, i.e., pillow region, can form a continuous pillow region in the fibrous structure made thereon. The knuckles can be arranged in a pattern described with reference to an X-Y plane, and the distance between knuckles 20 in at least one of X or Y directions can vary according to the present invention disclosed herein.

A second way to provide visually perceptible features to a fibrous structure like a paper towel or bath tissue is embossing. Embossing is a well known converting process in which at least one embossing roll having a plurality of discrete embossing elements extending radially outwardly from a surface thereof can be mated with a backing, or anvil, roll to form a nip in which the fibrous structure can pass such that the discrete embossing elements compress the fibrous structure to form relatively high density discrete elements in the fibrous structure while leaving uncompressed, or substantially uncompressed, relatively low density continuous or substantially continuous network at least partially defining or surrounding the relatively high density discrete elements.

Embossed features in paper towels and bath tissues can be visible to the retail consumer of such products. As a result, the visual pattern generated by the pattern of knuckles and pillows can be designed to be visually appealing. Such patterns are well known in the art, and can be made according to the methods and processes described in US Pub. No. US 2010-0028621 A1 in the name of Byrne et al. or US 2010-0297395 A1 in the name of Mellin, or U.S. Pat. No. 8,753,737 issued to McNeil et al. on Jun. 17, 2014.

In an embodiment, a fibrous structure of the present invention has a pattern of knuckles and pillows imparted to it by a papermaking belt having a corresponding pattern of knuckles and pillows that provides for superior product performance and is visually appealing to a retail consumer.

In an embodiment, a fibrous structure of the present invention has a pattern of knuckles and pillows imparted to it by a papermaking belt having a corresponding pattern of knuckles and an emboss pattern, which together with the knuckles and pillows provides for an overall visual appearance that is appealing to a retail consumer.

In an embodiment, a fibrous structure of the present invention has a pattern of knuckles and pillows imparted to it by a papermaking belt having a corresponding pattern of knuckles, an emboss pattern, which together with the knuckles and pillows provides for an overall visual appearance that is appealing to a retail consumer, and exhibits superior product performance over known fibrous structures.

"Fibrous structure" as used herein means a structure that comprises one or more fibers. Paper is a fibrous structure. Nonlimiting examples of processes for making fibrous structures include known wet-laid papermaking processes and air-laid papermaking processes, and embossing and printing processes. Such processes typically comprise the steps of preparing a fiber composition in the form of a suspension in a medium, either wet, more specifically aqueous medium, or dry, more specifically gaseous (i.e., with air as medium). The aqueous medium used for wet-laid processes is oftentimes referred to as a fiber slurry. The fibrous suspension is then used to deposit a plurality of fibers onto a forming wire or papermaking belt such that an embryonic fibrous structure can be formed, after which drying and/or bonding the fibers together results in a fibrous structure. Further processing the fibrous structure can be carried out such that a finished fibrous structure can be formed. For example, in typical papermaking processes, the finished fibrous structure is the fibrous structure that is wound on the reel at the end of papermaking, and can subsequently be converted into a finished product (e.g., a sanitary tissue product).

The fibrous structures of the present disclosure can exhibit a basis weight of greater than about 15 g/m$^2$ (9.2 lbs/3000 ft$^2$) to about 120 g/m$^2$ (73.8 lbs/3000 ft$^2$), alternatively from about 15 g/m$^2$ (9.2 lbs/3000 ft$^2$) to about 110 g/m$^2$ (67.7 lbs/3000 ft$^2$), alternatively from about 20 g/m$^2$ (12.3 lbs/3000 ft$^2$) to about 100 g/m$^2$ (61.5 lbs/3000 ft$^2$), and alternatively from about 30 g/m$^2$ (18.5 lbs/3000 ft$^2$) to about 90 g/m$^2$ (55.4 lbs/3000 ft$^2$). In addition, the sanitary tissue products and/or the fibrous structures of the present disclosure can exhibit a basis weight between about 40 g/m$^2$ (24.6 lbs/3000 ft$^2$) to about 120 g/m$^2$ (73.8 lbs/3000 ft$^2$), alternatively from about 50 g/m$^2$ (30.8 lbs/3000 ft$^2$) to about 110 g/m$^2$ (67.7 lbs/3000 ft$^2$), alternatively from about 55 g/m$^2$ (33.8 lbs/3000 ft$^2$) to about 105 g/m$^2$ (64.6 lbs/3000 ft$^2$), and alternatively from about 60 g/m$^2$ (36.9 lbs/3000 ft$^2$) to about 100 g/m$^2$ (61.5 lbs/3000 ft$^2$).

The fibrous structures of the present disclosure can exhibit a density (measured at 95 g/in$^2$) of less than about 0.60 g/cm$^3$, alternatively less than about 0.30 g/cm$^3$, alternatively less than about 0.20 g/cm$^3$, alternatively less than about 0.10 g/cm$^3$, alternatively less than about 0.07 g/cm$^3$, alternatively less than about 0.05 g/cm$^3$, alternatively from about 0.01 g/cm$^3$ to about 0.20 g/cm$^3$, and alternatively from about 0.02 g/cm$^3$ to about 0.10 g/cm$^3$.

The fibrous structures of the present disclosure can be in the form of sanitary tissue product rolls. Such sanitary tissue product rolls can comprise a plurality of connected, but perforated sheets of one or more fibrous structures, that are separably dispensable from adjacent sheets, such as is known for paper towels and bath tissue, which are both considered sanitary tissue products when in roll form.

The fibrous structures of the present disclosure can comprises additives such as softening agents, temporary wet strength agents, permanent wet strength agents, bulk softening agents, lotions, silicones, wetting agents, latexes, especially surface-pattern-applied latexes, dry strength agents such as KYMENE® wet strength additive, polyamido-amine-epichlorhydrin (PAE), carboxymethylcellulose and starch, and other types of additives suitable for inclusion in and/or on sanitary tissue products and/or fibrous structures.

"Machine Direction" or "MD" as used herein means the direction on a web corresponding to the direction parallel to the flow of a fibrous web or fibrous structure through a fibrous structure making machine.

"Cross Machine Direction" or "CD" as used herein means a direction perpendicular to the Machine Direction in the plane of the web.

"Relatively low density" as used herein means a portion of a fibrous structure having a density that is lower than a relatively high density portion of the fibrous structure. The relatively low density can be in the range of 0.02 g/cm$^3$ to 0.09 g/cm$^3$, for example relative to a high density that can be in the range of 0.1 to 0.13 g/cm$^3$.

"Relatively high density" as used herein means a portion of a fibrous structure having a density that is higher than a relatively low density portion of the fibrous structure. The relatively high density can be in the range of 0.1 to 0.13 g/cm$^3$, for example, relative to a low density that can be in the range of 0.02 g/cm$^3$ to 0.09 g/cm$^3$.

"Substantially continuous" as used herein with respect to high or low density networks means the network fully defines or surrounds more of the discrete deflection cells than it partially defines or surrounds. The substantially continuous member can be interrupted by macro patterns formed in the papermaking belt, as disclosed in U.S. Pat. No. 5,820,730 issued to Phan et al. on Oct. 13, 1998.

"Substantially continuous deflection conduit" is also referred to a "substantially continuous pillow" and as used herein means a portion of a papermaking belt or fibrous structure that at least partially defines or surrounds a plurality of knuckles, i.e., discrete portions raised from a papermaking belt or fibrous structure. The substantially continuous conduit will fully define or surround more of the knuckles than it partially defines or surrounds. The substantially continuous deflection conduit can be interrupted by macro patterns formed in the papermaking belt.

"Discrete deflection cell" also referred to a "discrete pillow" and as used herein means a portion of a papermaking belt or fibrous structure defined or surrounded by, or at least partially defined or surrounded by, a substantially continuous knuckle portion, i.e., a substantially continuous network of raised portions on a papermaking belt or fibrous structure.

"Discrete raised portion" as used herein means a discrete knuckle, i.e., a portion of a papermaking belt or fibrous structure defined or surrounded by, or at least partially defined or surrounded by, a substantially continuous deflection conduit or relatively low density pillow region that has an enclosed perimeter.

Fibrous Structures

The fibrous structures of the present disclosure can be single-ply or multi-ply fibrous structures and can comprise cellulosic pulp fibers. Other naturally-occurring and/or non-naturally occurring fibers can also be present in the fibrous structures. In one example, the fibrous structures can be throughdried in a TAD process, thus producing what is referred to as "TAD paper". The fibrous structures can be wet-laid fibrous structures and can be incorporated into single- or multi-ply sanitary tissue products.

The fibrous structures of the invention will be described in the context of paper towels, and in the context of a papermaking belt comprising cured resin on a woven reinforcing member. However, the invention is not limited to paper towels and can be made in other known processes that impart the knuckles and pillow patterns describe herein, including, for example, the fabric crepe and belt crepe processes described above, modified as described herein to produce the papermaking belts and paper of the invention.

In general, the fibrous structure, e.g., paper towel, of the invention can be made in a process utilizing a papermaking belt that has a pattern of resin cured knuckles on a woven reinforcing member, of the type described in reference to FIG. 1. The resin is cured in a pattern dictated by a patterned mask having opaque regions and transparent regions. The transparent regions permit curing radiation to penetrate to cure the resin, while the opaque regions prevent the curing radiation from curing portions of the resin. Once curing is achieved, the uncured resin is washed away to leave a pattern of cured resin that is substantially identical to the mask pattern. The cured portions are the knuckles of the belt, and the uncured portions are the pillows or deflection conduits of the papermaking belt. Thus, the mask pattern is replicated in papermaking belt, which pattern is essentially replicated in the fibrous structure. Therefore, in describing the pattern of knuckles and pillows in the fibrous structure of the invention, the pattern of the mask can serve as a proxy, and in the description below a visual description of the mask may be provided, and one is to understand that the dimensions and appearance of the mask is essentially identical to the dimensions and appearance of the papermaking belt made by the mask, and the fibrous structure made on the papermaking belt. Further, in processes that use a papermaking belt not made from a mask, the appearance and structure of the papermaking belt in the same way is imparted to the paper, such that the dimensions of features on the papermaking belt can also be measured and characterized as a proxy for the dimensions and characteristics of the finished paper.

Figure 2:
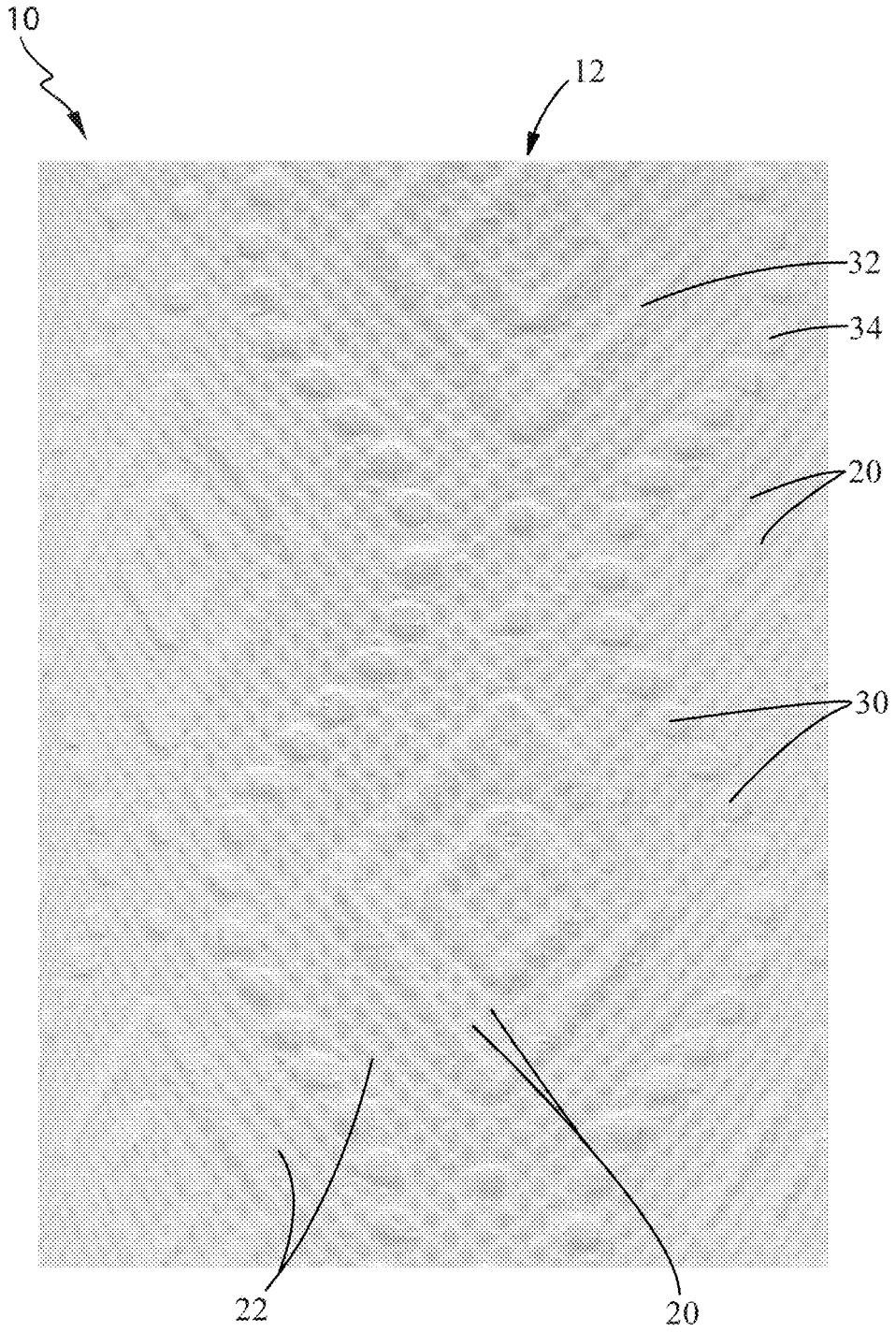
Fig. 2 PRIOR ART
FIG. 2 is a photograph of a portion of a paper towel product marketed by The Procter & Gamble Co.
Figure 3:
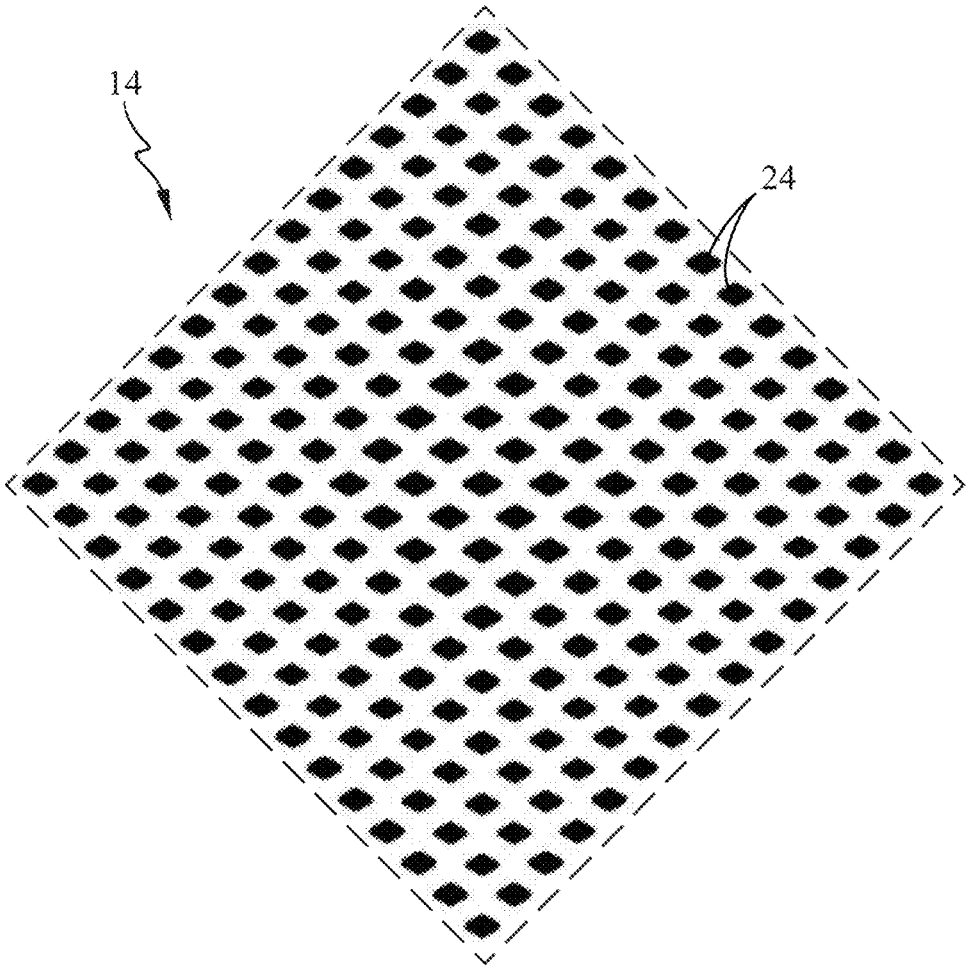
Fig. 3 PRIOR ART
FIG. 3 is a plan view of a mask used to make the papermaking belt that produced the paper towel of FIG. 2.

FIG. 2 illustrates a portion of a sheet on a roll 10 of sanitary tissue 12 currently marketed by The Procter & Gamble Co. as BOUNTY® paper towels. FIG. 3 shows the mask 14 used to make the papermaking belt (not shown, but of the type shown in FIG. 1, having the pattern of knuckles corresponding to the mask of FIG. 3) that made the sanitary tissue 12 shown in FIG. 4. As shown, the sanitary tissue exhibits a pattern of knuckles 20 which were formed by discrete cured resin knuckles on the papermaking belt, and which correspond to the black areas, referred to as cells 24 of the mask shown in FIG. 3. Any portion of the pattern of FIG. 3 that is black represents a transparent region of the mask, which permits UV-light curing of UV-curable resin to form a knuckle on the papermaking belt. Likewise, each knuckle on the papermaking belt forms a knuckle 20 in sanitary tissue 12, which can be a relatively high density region or a region of different basis weight relative to the pillow regions. Any portion of the pattern of FIG. 4 that is white represents an opaque region of the mask, which blocks UV-light curing of the UV-curable resin. The uncured resin is ultimately washed away to form a deflection conduit on the papermaking belt, which can form a relatively low density pillow 22 in the fibrous structure.

In embodiments of fibrous structures using belts formed by masks that dictate the eventual relative densities of the discrete elements and continuous elements of fibrous structures, such as the one shown in FIG. 3, the relative densities can be inverted such that the fibrous structure has relatively low density areas where relatively high density areas are (in FIG. 3) and, similarly, relatively high density areas where relatively low density areas are (in FIG. 3). As can be understood by the description herein, the inverse relationship can be achieved by inverting the black and white (or, more generally, the opaque and transparent) portions of the mask used to make the belt that is used to make the fibrous structure. This inverse relation (black/white) can apply to all patterns of the present disclosure, although all fibrous structures/patterns of each category are not illustrated for brevity since the concept is illustrated in FIGS. 2 and 3. The papermaking belts of the present disclosure and the process of making them are described in further detail below.

The BOUNTY® paper towel shown in FIG. 2 has enjoyed tremendous market success. The product's performance together with its aesthetic visual appearance has proven to be very desirable to retail consumers. The visual appearance is due to the pattern of knuckles 20 and pillows 22 and the pattern of embossments 30. As shown, the BOUNTY® paper towel has both line embossments 32 and "dot" embossments 34. The pattern of knuckles 20 and pillows 22 can be considered to be a "wet-formed" background pattern, with the pattern of embossments 30 overlaid thereon being considered "dry-formed". Thus, the pattern of knuckles and pillows and the embossments together give the paper towel its visual appearance.

The BOUNTY® paper towel shown in FIG. 2 will be used to contrast the disclosed embodiments of the invention, as it serves as benchmark to describe inventive improvements in the field. Thus, the present invention represents an improvement over current technology, including that utilized for current BOUNTY® paper towels, and the improvements are described below with respect to key differences. The key differences are also shown in table form in Table 1, below.

TABLE 1

Comparison of in-market product and embodiments of the invention

| | PATTERN DESCRIPTION | | | | | | SUBSTRATE PERFORMANCE | |
|---|---|---|---|---|---|---|---|---|
| | CELL | CELL | CELL SIZE | | CELL LOCATION | | Absorbency Rate | Flexural Rigidity/ Total Dry |
| DESIGN | SHAPE | ORIENTATION | KNUCKLE | PILLOW | UNIFORM | RANDOM | ($g/sec^{1/2}$) | Tensile |
| In Market Bounty | CONSTANT | CONSTANT | VARYING | CONSTANT | X | | 1.65 | 0.40 |
| INVENTION 1 | CONSTANT | CONSTANT | CONSTANT | VARYING | | 1D | 2.1 | 0.51 |
| INVENTION 2 | CONSTANT | CONSTANT | VARYING | VARYING | | 2D | 1.97 | 0.47 |
| INVENTION 3 | CONSTANT | CONSTANT | CONSTANT | VARYING | X | | 1.91 | 0.48 |

As used in Table 1, the term "cell" is used to represent the discrete element of a mask, belt, or fibrous structure. Thus, as illustrated herein, the term cell can represent discrete black (transparent) portions of a mask, a discrete resinous element on a papermaking belt, or a discrete relatively high or low density portion of a fibrous structure. In terms of dimensions, including relative size and spacing, the three are substantially exact, or close approximations of one another. In the description herein, the schematic representation of cells 24 can be considered representations of a discrete element of one or more transparent portions of a mask, one or more knuckles on a papermaking belt, or one or more knuckles in a fibrous structure. But the invention is not limited to one method of making, so the term cell can refer to a discrete feature such as a raised element, a dome-shaped element or knuckle formed by belt or fabric creping on a fibrous structure, for example.

Table 1 further records the cell size and spacing characteristics for the current BOUNTY® paper towel and embodiments of the invention. For BOUNTY® and the embodiments of the invention shown in Table 1, the cells are knuckles of a sanitary tissue. That is, the fibrous structures made in the present invention recorded in Table 1 each exhibit a structure of discrete knuckles and a continuous pillow region. Therefore, Table 1 records cell sizes as the area of the knuckles when viewed in plan view and cell spacing in terms of the distances between adjacent knuckles, as described below. In general, the knuckle area of each cell can be constant, i.e., each knuckle exhibits the same area, or varying, i.e., different size cells, presenting at least two different knuckle areas. Likewise, the pillow region can be defined by the spacing between cells as measured in either one or more directions of a coordinate reference plane, or variable spacing between cells as measured in one or more directions of a coordinate reference plane.

Finally, Table 1 records substrate performance parameters important to commercially successful fibrous structures, particularly paper towels. Absorbency rate, measured as Slope of the Square Root of Time (SST), and Flexural Rigidity/Total Dry Tensile (FR/TDT), each measured according to the test methods in the Test Methods section below, for example, are shown to be significantly improved in the present invention, as discussed below.

The BOUNTY® paper towel shown in FIG. 2 has a pattern of discrete knuckles and a continuous pillow region, which is the relatively low density region surrounding the discrete knuckles. The cell 24 shape and cell 24 orientation are both constant in a uniform cell location. The knuckle size varies but the pillow width (as discussed below) is constant. Current market BOUNTY® paper towel shown in FIG. 2 has the product performance properties shown in Table 1. Specifically, the BOUNTY® paper towel has product performance characteristics, including SST of 1.65 $g/sec^{1/2}$ and FR/TDT of 0.40.

Figure 4:
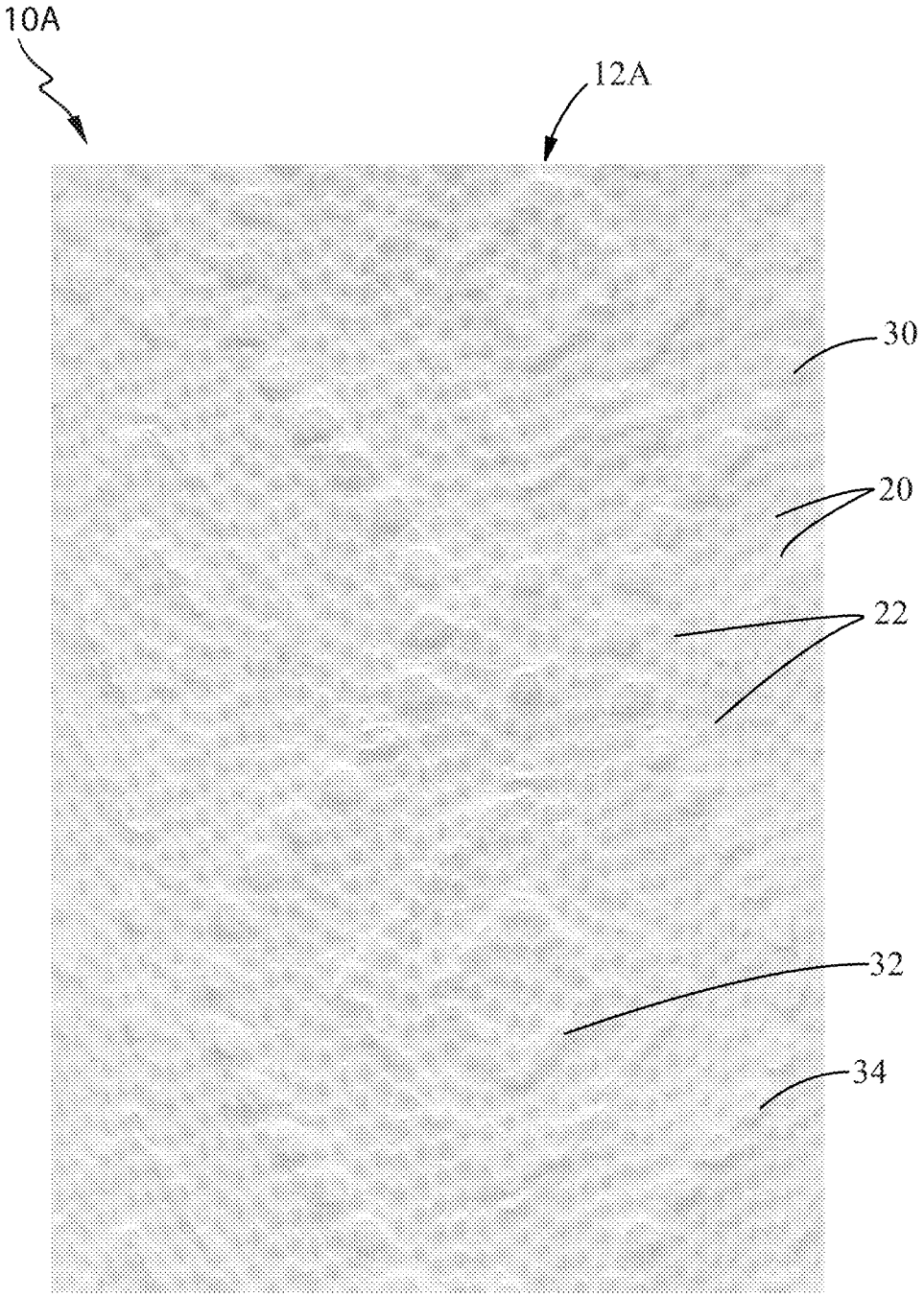
FIG. 4 is a photograph of a portion of a fibrous structure product of the present invention.
Figure 5:
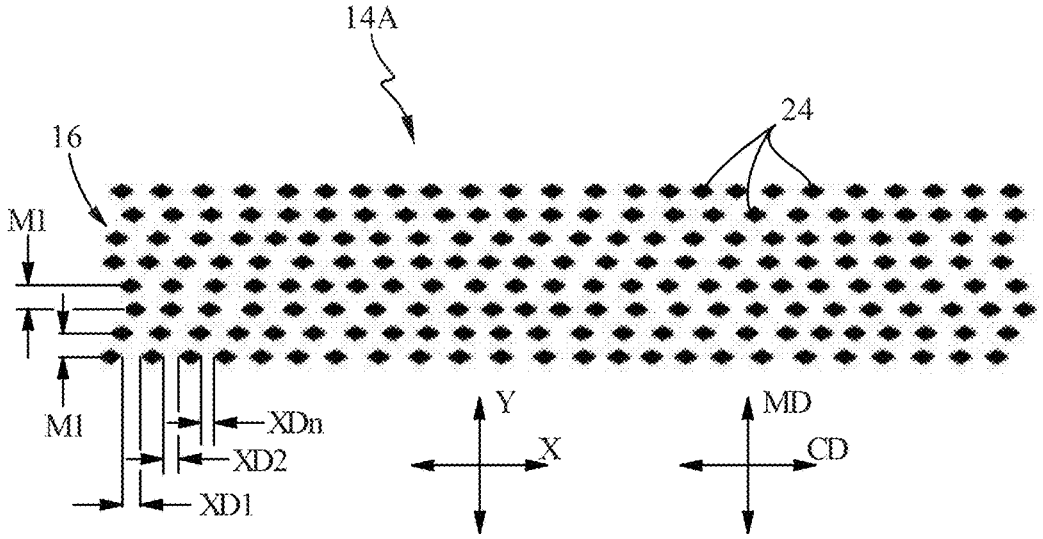
FIG. 5 is a plan view of a repeat pattern for a mask used to make the papermaking belt that produced the fibrous structure of FIG. 4.

In an effort to improve the product performance properties of the current BOUNTY® paper towel, the inventors designed a new pattern for the distribution of knuckles and pillows. FIG. 4 illustrates a roll 10A of sanitary tissue 12A produced with the new pattern, referred to herein as INVENTION 1. FIG. 5 shows one repeat unit 16 of the pattern of the mask 14A used to make the papermaking belt (not shown, but of the type shown in FIG. 1, having the pattern of knuckles corresponding to the mask of FIG. 5) that made the sanitary tissue 12A shown in FIG. 4. Again, as with the pattern above, the sanitary tissue exhibits a pattern of knuckles 20 which were formed by discrete cured resin knuckles on the papermaking belt, and which correspond to the black areas, i.e., the cells 24, of the mask 14A shown in FIG. 4.

Figure 6:
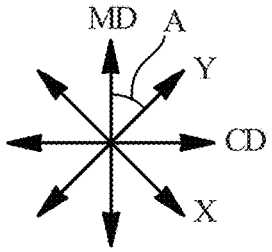
FIG. 6 is representation of how patterns of cells can be oriented in the present invention.

The paper towel of INVENTION 1 differs from in-market BOUNTY® in that the cells are uniform-size and uniform-shape, but are spaced in a pattern in which the pillow widths vary within a row of cells parallel to one axis, e.g., the X-axis as shown in FIG. 5. It is to be noted that "rows" is not be taken strictly as straight rows, but the rows could be curved, such as in a sinusoidal pattern, wavy pattern, or the like. As shown in FIG. 5, the cell pattern for INVENTION 1 can be understood in the context of an X-Y coordinate plane, which can also, but not necessarily, correspond to the MD and CD directions of papermaking. In an embodiment, the X-Y plane of the pattern shown in FIG. 4 need not align with the MD and CD directions of papermaking. As shown in FIG. 6, the pattern of cells can be in the form of uniform repeat units that as a whole can be oriented at an angle A with respect to the MD and CD directions of papermaking.

In an embodiment, the cells can be understood to be in rows in one direction, e.g., the X-direction as shown in FIG. 5. The rows can be evenly and equally spaced in a direction, e.g., the Y-direction as shown in FIG. 4. The distances YD1, YD2 YDn can be equal, and for cell sizes having a maximum Y-direction dimension of between 0.015 inch and 0.250 inch YDn can be between 0.020 inch and 0.200 inch. Within a row, however, the uniform-size cells need not be spaced equally, but the distances XD1, XD2 XDn can vary from between about 0.010 inch to about 0.100 inch or from between about 0.030 inch to about 0.080 inch.

Figure 7:
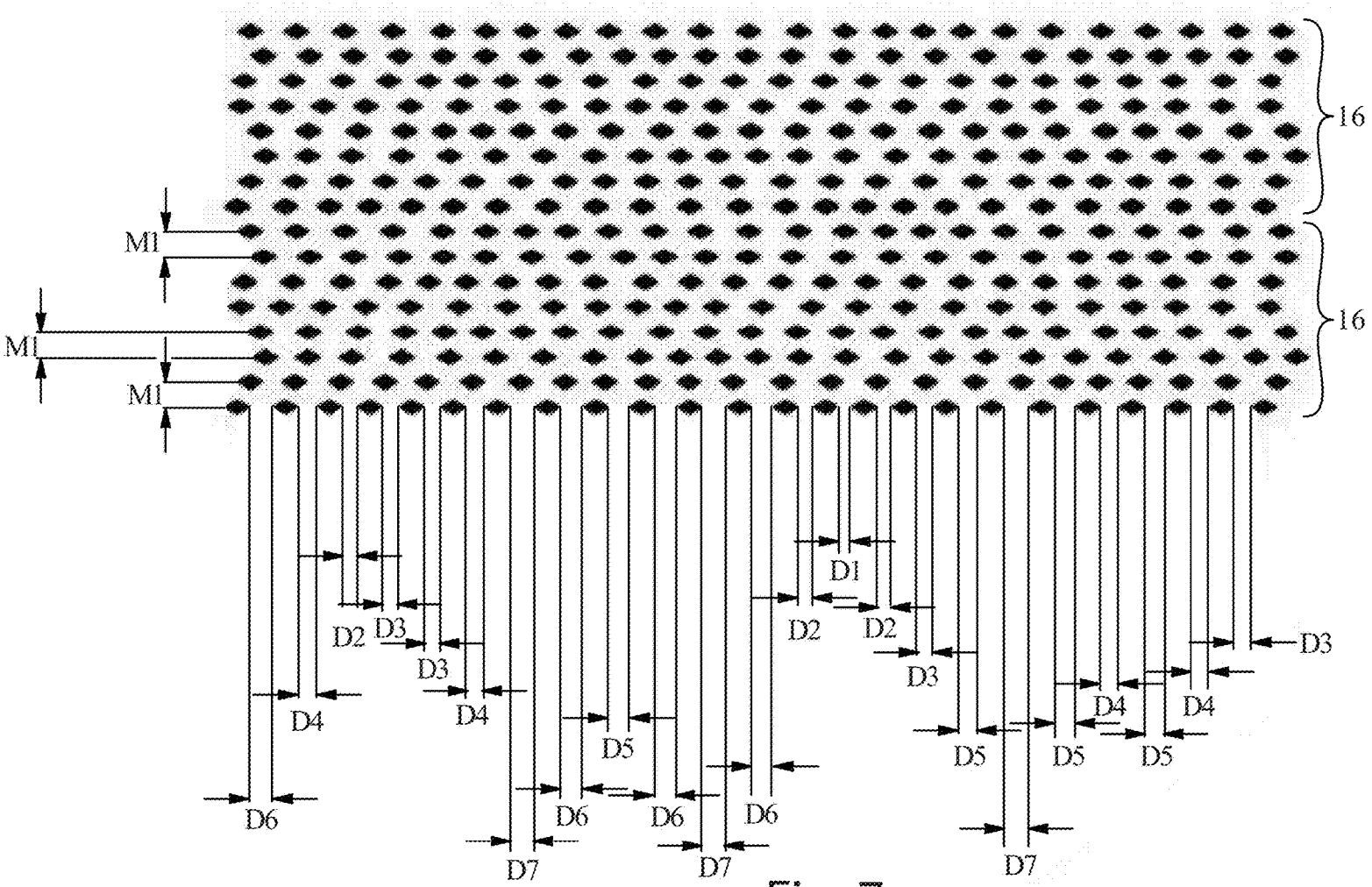
FIG. 7 shows two repeat units for a pattern for a mask used to make the papermaking belt that produced the fibrous structure of FIG. 4.

The range of width values for XD1, XD2 XDn can be predetermined to repeat in a uniform pattern, and can be predetermined to have a desired distribution, including a bi-modal distribution. FIG. 7 shows a non-limiting example of a repeat pattern for XDn, with the like numbers representing equal distances. In the example pattern of FIG. 7, the dimensions are: XD1=0.030 inch; XD2=0.035 inch; XD3=0.040 inch; XD4=0.045 inch; XD5=0.050 inch; XD6=0.055 inch; and, XD7=0.060 inch.

Each cell can have a maximum X-direction dimension which defines an outer boundary in the X-direction, the tangent of which can be used to determine XDn. Likewise, each cell can have a maximum Y-direction dimension, which defines an outer boundary in the Y-direction. However, a centerline through centerpoints of the cells in an X-direction row can be used to determine YDn. Each cell can have a maximum X-direction dimension of between about 0.015 inches and 0.250 inches and a maximum Y-direction dimension of between about 0.015 inches and 0.250 inches and a two-dimensional projected area (as cells are depicted in FIG. 4), of between about 0.000176 $in^2$ and 0.0625 $in^2$.

The paper towel of INVENTION 1 exhibits an absorbency rate (SST) of 2.1 $g/sec^{1/2}$, which represents a significant product performance increase for fibrous structures used for their absorbent properties. Further, the paper towel of INVENTION 1 exhibits a FR/TDT of 0.51, driven primarily by an increase in flexural rigidity, which, for paper towels, contributes to the experience of being substantial in hand or sturdy which communicates to the consumer a cloth-like nature of the product.

Figure 8:
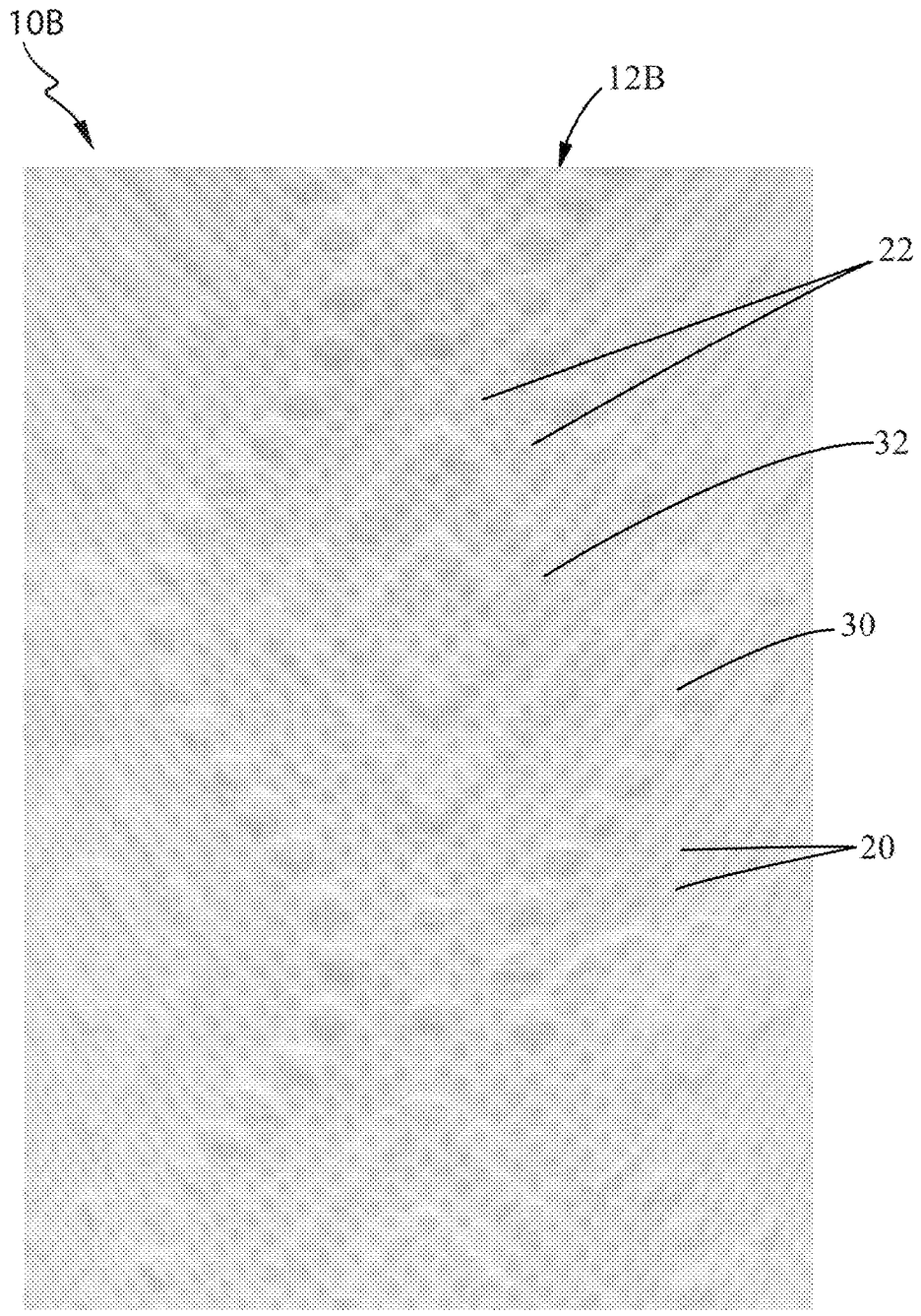
FIG. 8 is a photograph of a fibrous structure product of the present invention.
Figure 9:
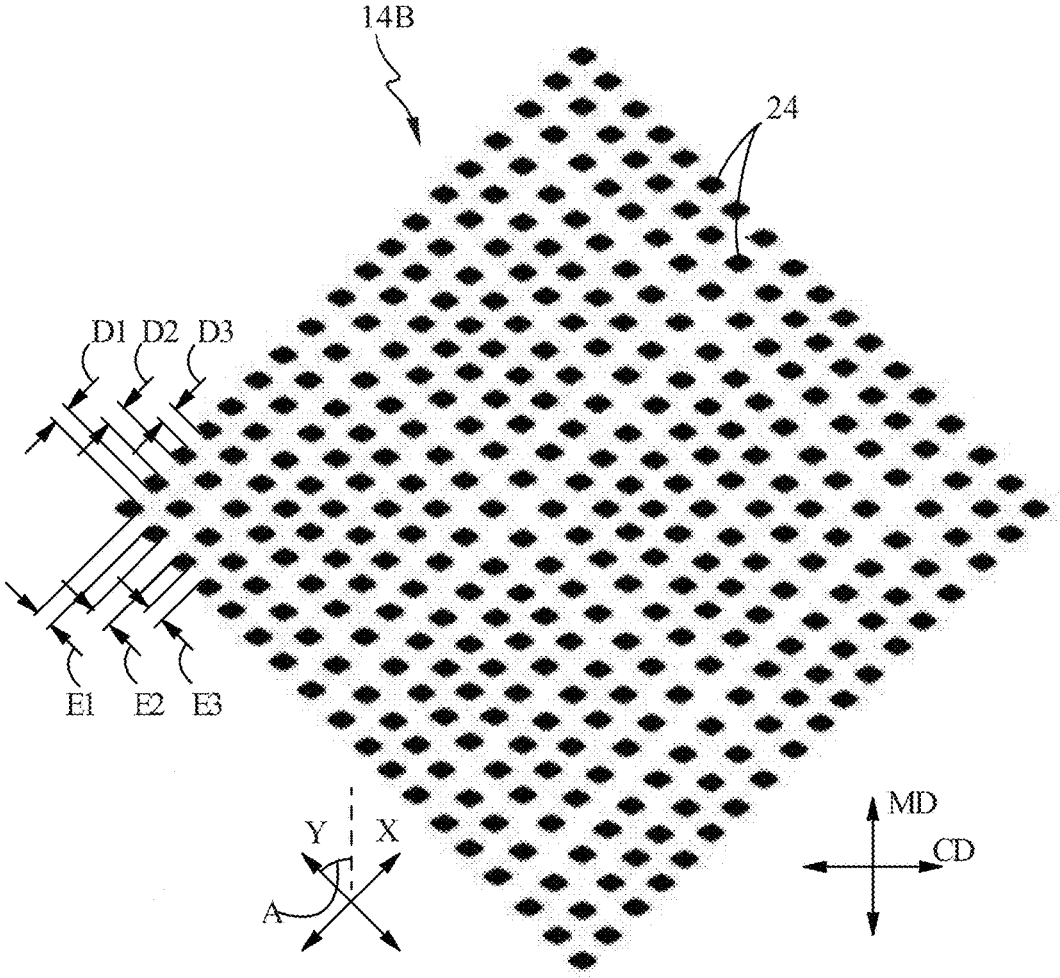
FIG. 9 is a plan view of a repeat unit of a mask used to make the papermaking belt that produced the fibrous structure of FIG. 8.

While the increased product performance is important, significant, and unexpected, the inventor found that when INVENTION 1 was embossed with a pattern similar to that of current BOUNTY® paper towels, the overall visual impression was not aesthetically acceptable when compared to current BOUNTY® paper towels. In an effort to improve the visual appearance of a paper towel product having the improved performance characteristics of INVENTION 1, the inventors designed a yet another new pattern for the knuckles and pillows of a fibrous structure. FIG. 8 illustrates a portion of a roll 10B of sanitary tissue 12B produced with the new pattern, referred to herein as INVENTION 2. FIG. 9 shows a repeat unit of the mask 14B used to make the papermaking belt (not shown, but of the type shown in FIG. 1, having the pattern of knuckles corresponding to the mask of FIG. 9) that made the sanitary tissue 12B shown in FIG. 8. Again, as with the pattern above, the sanitary tissue exhibits a pattern of knuckles 20 which were formed by discrete cured resin knuckles on the papermaking belt, and which correspond to the black areas, i.e., cells 24 of the mask shown in FIG. 9.

INVENTION 2 differs from INVENTION 1 in that in that the uniform-size and uniform-shape cells are spaced in a pattern in which the pillow widths vary within a row of cells along both of two axes, e.g., an X-Y axis. Again, it is to be noted that "rows" is not be taken strictly as straight rows, but the rows could be curved, such as in a sinusoidal pattern, wavy pattern, or the like. As shown in FIG. 9, the cell pattern for INVENTION 2 can be understood in the context of an X-Y coordinate plane oriented at an angle A to the MD. In an embodiment, the cells can be understood to be in rows in two directions, e.g., the X-direction and Y-direction, as shown in FIG. 8. Within both rows the uniform-size cells are not spaced equally, but the distances XD1, XD2 XDn and YD1, YD2 YDn are not necessarily equal, and can vary from between about 0.030 inch to about 0.080 inch. The range of width values along either direction can be predetermined to repeat in a uniform pattern, and can be predetermined to have a desired distribution, including a bi-modal distribution. Each cell can have a maximum X-direction dimension which defines an outer boundary in the X-direction, the tangent of which can be used to determine XDn. Likewise, each cell can have a maximum Y-direction dimension, which defines an outer boundary in the Y-direction. The cells can have a two-dimensional projected area (as cells are depicted in FIG. 9), of between about 0.000176 $in^2$ and 0.0625 $in^2$.

INVENTION 2 has an improved absorbency rate (SST) (relative to in-market BOUNTY®) of 1.97 $g/sec^{1/2}$ and an FR/TDT value of 0.47. While the increased absorbency and sturdiness is again important, the inventor found that when INVENTION 2 was embossed 30 with a pattern similar to that of current BOUNTY® paper towels, the overall visual impression was aesthetically acceptable, and on par with current in-market BOUNTY® paper towels.

Figure 10:
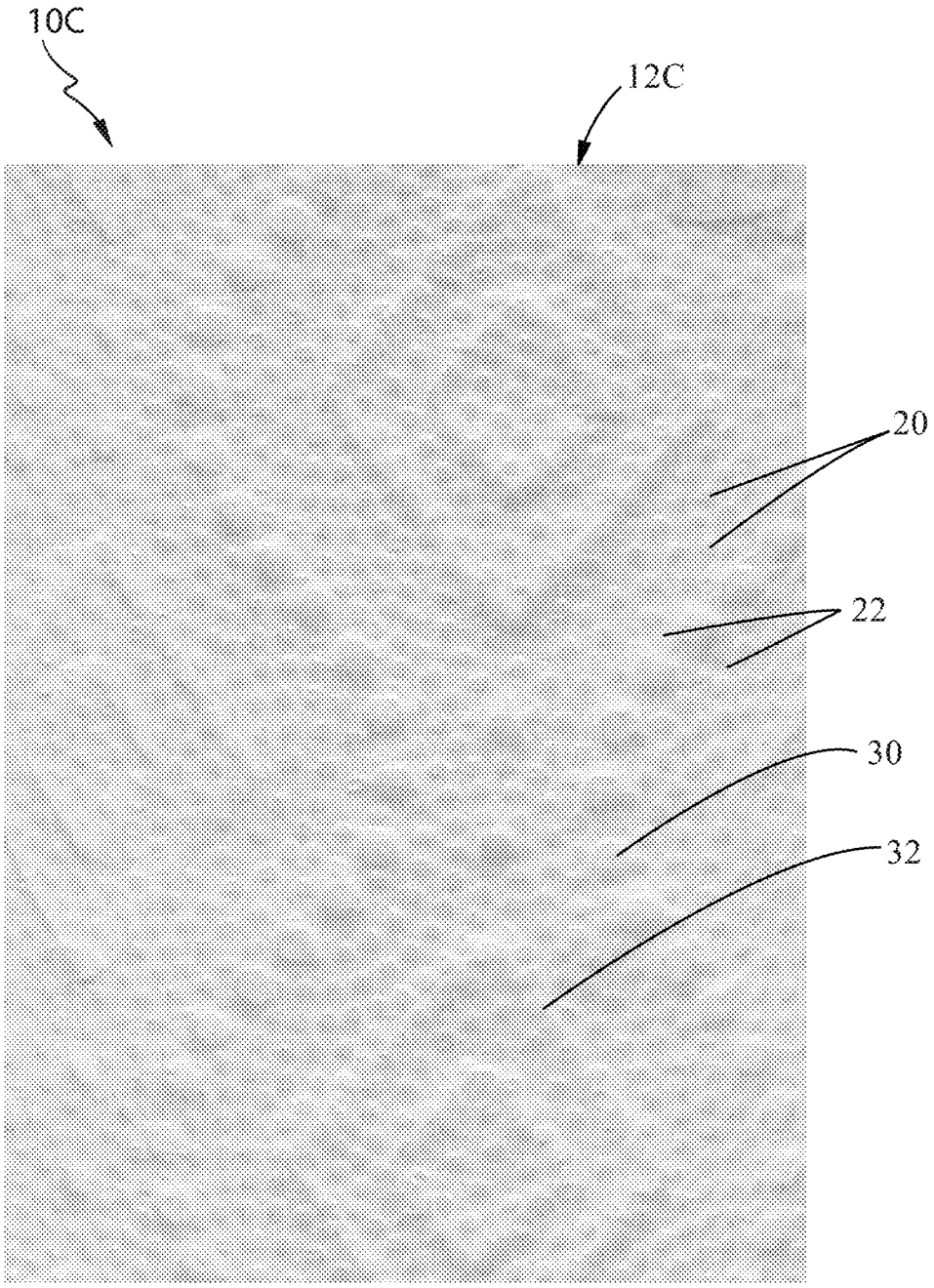
FIG. 10 is a photograph of a fibrous structure product of the present invention.
Figure 11:
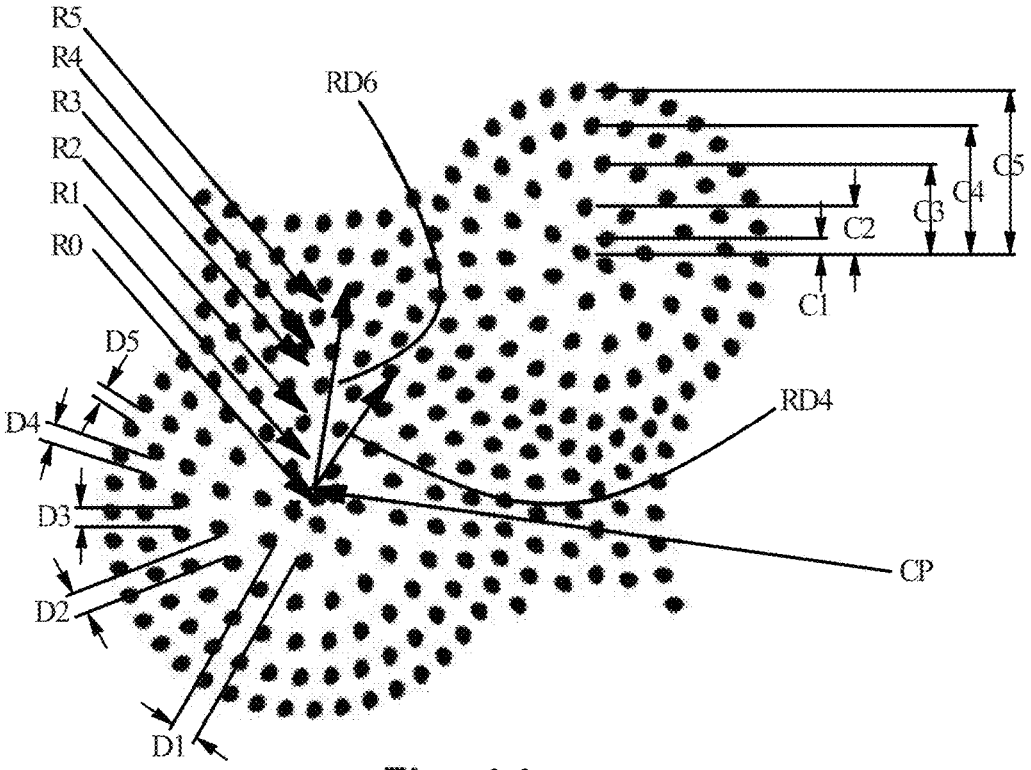
FIG. 11 is a plan view of a repeat unit of a mask used to make the papermaking belt that produced the fibrous structure of FIG. 10.

In an effort to maintain the improved absorbency properties and improve visual appearance of a paper towel product, the inventors designed yet another new pattern for the knuckles and pillows of a fibrous structure. FIG. 10 illustrates a roll 10C of sanitary tissue 12C produced with the new pattern, referred to herein as INVENTION 3. FIG. 11 shows the mask 14C used to make the papermaking belt (not shown, but of the type shown in FIG. 1, having the pattern of knuckles corresponding to the mask of FIG. 11) that made the sanitary tissue 12C shown in FIG. 10. Again, as with the pattern above, the sanitary tissue exhibits a pattern of knuckles 20 which were formed by discrete cured resin knuckles on the papermaking belt, and which correspond to the black areas, i.e., cells 24, of the mask shown in FIG. 11.

Figure 12:
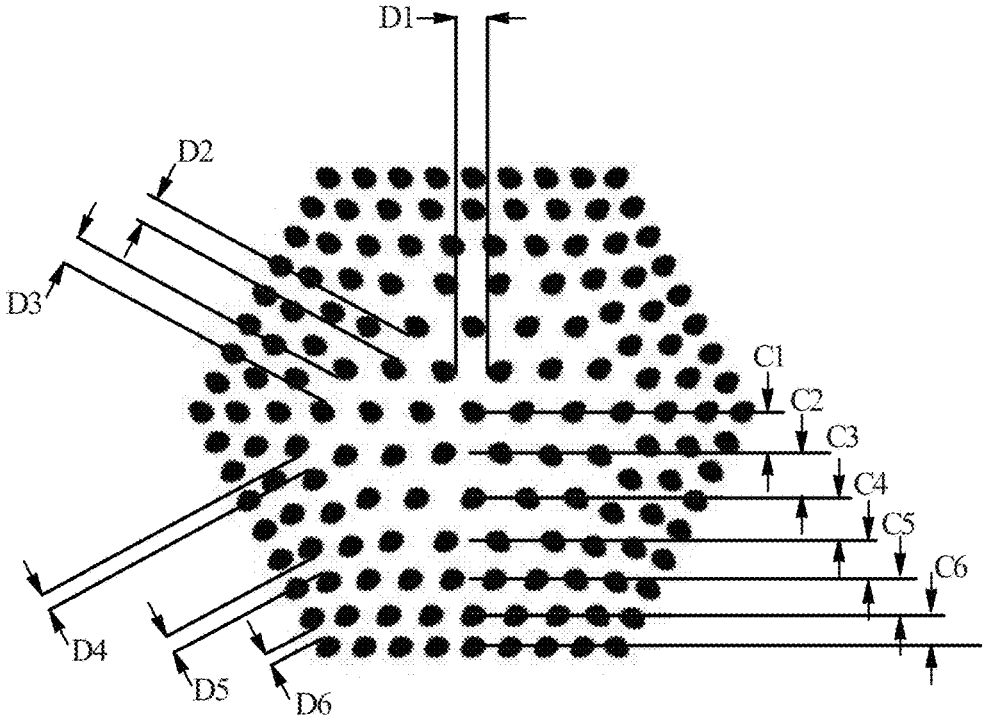
FIG. 12 is a plan view of an alternative repeat unit of a mask suitable for making a papermaking belt to produce a fibrous structure of the present invention.

INVENTION 3 differs from the previous embodiments in that the uniform-size and uniform-shape cells are spaced in a repeat unit exhibiting one or more generally radial patterns of cells. The repeat unit shown in FIG. 11 has two generally radial patterns. For each generally radial pattern the cell pattern repeat unit can include "rows" of cells, each row being one of a series of concentric geometric shapes, which shapes can approximate a circle, as shown in FIG. 11, or other geometric shape, as shown in FIG. 12. The space between the outer boundaries of the last row of the geometric shape can be filled with a pattern of spaced apart cells in which the pillow widths between adjacent cells can differ within a range of about 0.030 inch to about 0.080 inch.

In the cell pattern of INVENTION 3, each row of cells, e.g., R1, R2 Rn is spaced at a radial distance RD1, RD2 RDn, respectively from a centerpoint CP of the cell repeating pattern, such as the indicated RD distances RD4 (distance form centerpoint to Row 4) and RD6 (distance from centerpoint to Row 6). The centerpoint CP can be approximated or calculated from the digital image of the cell pattern used for the mask. The distance RDn can be an average distance from the centerpoint CP to each cell of a given row. The shortest line between the side edges of adjacent cells within a row defines a distance D, and the repeat pattern can be designed such as that the distance D between cells within a row is equal, but the distance between cells row to row decreases from the inside out. That is, distance D1, which is the distance between the side edges of adjacent cells within Row 1 is greater than the distance D2, which is the distance between the side edges of adjacent cells within Row 2, and so on until the last row at a distance Dn, which in the embodiment of FIG. 11 is Row 6. The distances RDn can vary in a range from of about 0.030 inch to about 0.080 inch. Likewise, the distances D can vary within a row in a range from of about 0.030 inch to about 0.080 inch.

INVENTION 3 has an improved absorbency rate (SST) (relative to in-market BOUNTY®) of 1.91 g/sec$^{1/2}$ and an FR/TDT value of 0.48. However, while the increased absorbency and sturdiness is again important, the inventor found that when INVENTION 3 was embossed with a pattern similar to that of current BOUNTY® paper towels, the overall visual impression was less aesthetically acceptable than that of current in-market BOUNTY® paper towels.

In all the examples of the invention above, in addition to superior absorbency rates and other beneficial properties, the resulting fibrous structures permit fibrous structure manufacturer to wind rolls with high roll bulk (for example greater than 4 cm$^3$/g) and firm roll percent compressibility (low percent compressibility, for example less than 10% compressibility).

In one example, any of the fibrous structures of the present invention described herein may be in the form of rolled tissue products (single-ply or multi-ply), for example a dry fibrous structure roll, and may exhibit a roll bulk (in units of cm$^3$/g) of greater than 4 and/or greater than 6 and/or greater than 8 and/or greater than 10 and/or greater than 12 and/or to about 20 and/or to about 18 and/or to about 16 and/or to about 14 and/or from about 4 to about 20 and/or from about 4 to about 12 and/or from about 8 to about 20 and/or from about 12 to about 16.

Additionally, any of the fibrous structures of the present invention described herein may be in the form of a rolled tissue products (single-ply or multi-ply), for example a dry fibrous structure roll, and may have a percent compressibility (in units of %) of less than 10 and/or less than 8 and/or less than 7 and/or less than 6 and/or less than 5 and/or less than 4 and/or less than 3 to about 0 and/or to about 0.5 and/or to about 1 and/or from about 4 to about 10 and/or from about 4 to about 8 and/or from about 4 to about 7 and/or from about 4 to about 6 as measured according to the Percent Compressibility Test Method described herein.

In one hypothetical example, such a rolled tissue product can exhibit a roll bulk of greater than 4 cm$^3$/g and a percent compressibility of less than 10% as measured according to the Percent Compressibility Test Method. In another example, such a rolled tissue product exhibits a roll bulk of greater than 6 cm$^3$/g and a percent compressibility of less than 8% as measured according to the Percent Compressibility Test Method. In still another example, such a rolled tissue product exhibits a roll bulk of greater than 8 cm$^3$/g and a % compressibility of less than 7% as measured according to the Percent Compressibility Test Method.

As used herein, the term "Roll Bulk" refers to the volume of paper divided by its mass on the wound roll of a rolled tissue product. Roll Bulk is calculated by multiplying pi (3.142) by the quantity obtained by calculating the difference of the roll diameter squared in cm squared (cm2) and the outer core diameter squared in cm squared (cm2) divided by 4, divided by the quantity sheet length in cm multiplied by the sheet count multiplied by the 55 bone dry Basis Weight of the sheet in grams (g) per cm squared (cm2).

The rolled tissue product of the invention can also exhibit a Percent Compressibility and Roll Bulk, each having any of the valued described above.

Additionally, each of the rolled tissue products can be individually packaged to protect the fibrous structure from environmental factors during shipment, storage and shelving for retail sale. Any of known methods and materials for wrapping bath tissue or paper towels can be utilized. Further, plurality of individual packages, whether individually wrapped or not, can be wrapped together to form a package having inside a plurality of rolled tissue products. The package can have 2, 3, 4, 5, 6, 7, 8, 9, 10, 12, 14, 16 or more rolls. In such packages, the roll bulk and percent compressibility can be important factors in package integrity during shipping, storage, and shelving for retail sale.

In an embodiment, the invention is a package of a plurality of individual rolled tissue products, in which at least one of the rolled tissue products exhibits a roll bulk of greater than 4 cm$^3$/g or a percent compressibility of less than 10 percent. In an embodiment, the invention is a package of a plurality of individual rolled tissue products, in which at least one of the rolled tissue products exhibits a roll bulk of greater than 4 cm$^3$/g and a percent compressibility of less than 10 percent. In an embodiment, the invention is a package of a plurality of individual rolled tissue products, in which at least one of the rolled tissue products exhibits a roll bulk of greater than 6 cm$^3$/g and a percent compressibility of less than 8 percent.

Papermaking Belts

The fibrous structures of the present disclosure can be made using a papermaking belt of the type described in FIG. 1, but having knuckles in the shape and pattern described herein. The papermaking belt can be thought of as a molding member. A "molding member" is a structural element having cell sizes and placement as described herein that can be used as a support for an embryonic web comprising a plurality of cellulosic fibers and/or a plurality of synthetic fibers as well as to "mold" a desired geometry of the fibrous structures during papermaking (i.e., excluding "dry" processes such as embossing). The molding member can comprise fluid-permeable areas and has the ability to impart a three-dimensional pattern of knuckles to the fibrous structure being produced thereon, and includes, without limitation, single-layer and multi-layer structures in the class of papermaking belts having UV-cured resin knuckles on a woven reinforcing member as disclosed in the above mentioned U.S. Pat. No. 6,610,173, issued to Lindsay et al. or U.S. Pat. No. 4,514,345 issued to Trokhan.

In one embodiment, the papermaking belt is a fabric crepe belt for use in a process as disclosed in the above mentioned U.S. Pat. No. 7,494,563, issued to Edwards, but having the pattern of cells, i.e., knuckles, as disclosed herein. Fabric crepe belts can be made by extruding, coating, or otherwise applying a polymer, resin, or other curable material onto a support member, such that the resulting pattern of three-dimensional features are belt knuckles with the pillow regions serving as large recessed pockets the fiber upon high impact creping in a creping nip between a backing roll and the fabric to form additional bulk in conventional wet press processes. In another embodiment, the papermaking belt can be a continuous knuckle belt of the type exemplified in FIG. 1 of U.S. Pat. No. 4,514,345 issued to Trokhan, having deflection conduits that serve as the recessed pockets of the belt shown and described in U.S. Pat. No. 7,494,563, for example in place of the fabric crepe belt shown and described therein.

In an example of a method for making fibrous structures of the present disclosure, the method can comprise the steps of:

(a) providing a fibrous furnish comprising fibers; and (b) depositing the fibrous furnish onto a molding member such that at least one fiber is deflected out-of-plane of the other fibers present on the molding member.

In still another example of a method for making a fibrous structure of the present disclosure, the method comprises the steps of:

(a) providing a fibrous furnish comprising fibers;

(b) depositing the fibrous furnish onto a foraminous member to form an embryonic fibrous web;

(c) associating the embryonic fibrous web with a papermaking belt having a pattern of knuckles as disclosed herein such that at a portion of the fibers are deflected out-of-plane of the other fibers present in the embryonic fibrous web; and (d) drying said embryonic fibrous web such that that the dried fibrous structure is formed. In another example of a method for making the fibrous structures of the present disclosure, the method can comprise the steps of:

(a) providing a fibrous furnish comprising fibers;

(b) depositing the fibrous furnish onto a foraminous member such that an embryonic fibrous web is formed;

(c) associating the embryonic web with a papermaking belt having a pattern of knuckles as disclosed herein such that at a portion of the fibers can be formed in the substantially continuous deflection conduits;

(d) deflecting a portion of the fibers in the embryonic fibrous web into the substantially continuous deflection conduits and removing water from the embryonic web so as to form an intermediate fibrous web under such conditions that the deflection of fibers is initiated no later than the time at which the water removal through the discrete deflection cells or the substantially continuous deflection conduits is initiated; and (e) optionally, drying the intermediate fibrous web; and (f) optionally, foreshortening the intermediate fibrous web, such as by creping.

Figure 13:
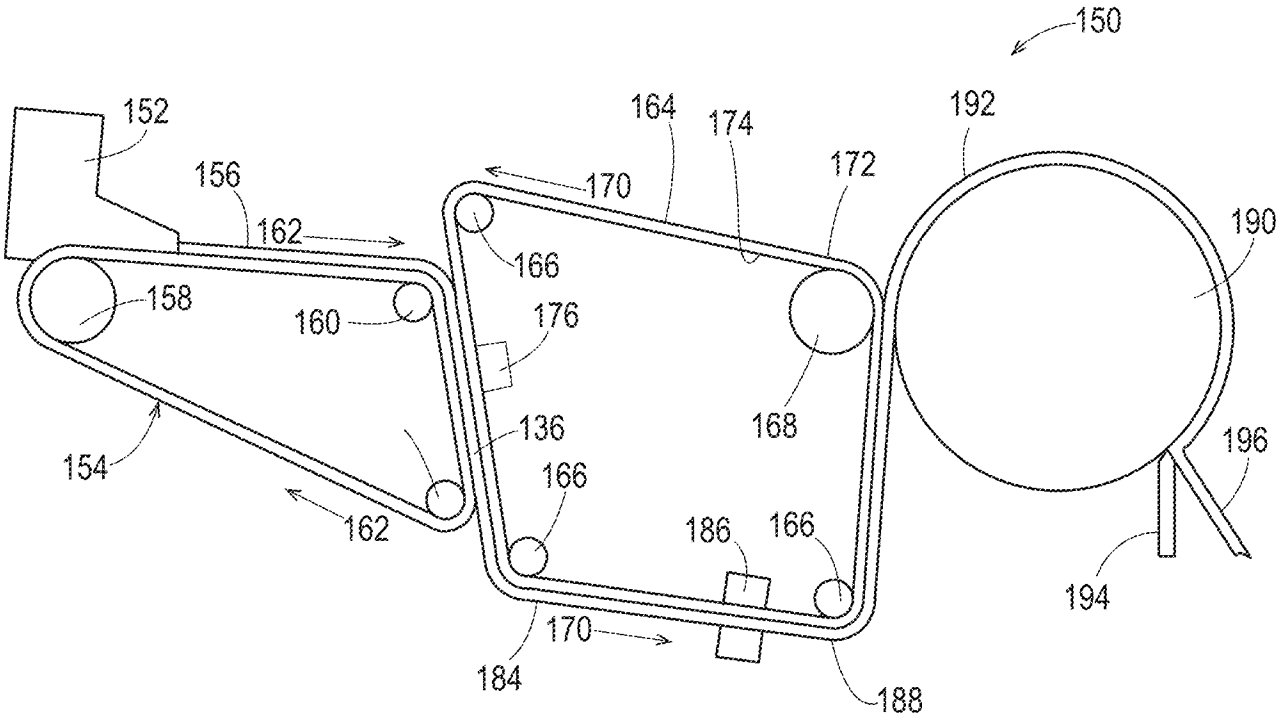
FIG. 13 is a schematic representation of one method for making a fibrous structure of the present invention.

FIG. 13 is a simplified, schematic representation of one example of a continuous fibrous structure making process and machine useful in the practice of the present disclosure. The following description of the process and machine include non-limiting examples of process parameters useful for making a fibrous structure of the present invention.

As shown in FIG. 13, process and equipment 150 for making fibrous structures according to the present disclosure comprises supplying an aqueous dispersion of fibers (a fibrous furnish) to a headbox 152 which can be of any design known to those of skill in the art. From the headbox 152, the aqueous dispersion of fibers can be delivered to a foraminous member 154, which can be a Fourdrinier wire, to produce an embryonic fibrous web 156.

The foraminous member 154 can be supported by a breast roll 158 and a plurality of return rolls 160 of which only two are illustrated. The foraminous member 154 can be propelled in the direction indicated by directional arrow 162 by a drive means, not illustrated, at a predetermined velocity, V1. Optional auxiliary units and/or devices commonly associated with fibrous structure making machines and with the foraminous member 154, but not illustrated, comprise forming boards, hydrofoils, vacuum boxes, tension rolls, support rolls, wire cleaning showers, and other various components known to those of skill in the art.

After the aqueous dispersion of fibers is deposited onto the foraminous member 154, the embryonic fibrous web 156 is formed, typically by the removal of a portion of the aqueous dispersing medium by techniques known to those skilled in the art. Vacuum boxes, forming boards, hydrofoils, and other various equipment known to those of skill in the art are useful in effectuating water removal. The embryonic fibrous web 156 can travel with the foraminous member 154 about return roll 160 and can be brought into contact with a papermaking belt 164, also referred to as a papermaking belt, in a transfer zone 136, after which the embryonic fibrous web travels on the papermaking belt 164. While in contact with the papermaking belt 164, the embryonic fibrous web 156 can be deflected, rearranged, and/or further dewatered.

The papermaking belt 164 can be in the form of an endless belt. In this simplified representation, the papermaking belt 164 passes around and about papermaking belt return rolls 166 and impression nip roll 168 and can travel in the direction indicated by directional arrow 170, at a papermaking belt velocity V2, which can be less than, equal to, or greater than, the foraminous member velocity V1. In the present invention papermaking belt velocity V2 is less than foraminous member velocity V1 such that the partially-dried fibrous web is foreshortened in the transfer zone 136 by a percentage determined by the relative velocity differential between the foraminous member and the papermaking belt. Associated with the papermaking belt 164, but not illustrated, can be various support rolls, other return rolls, cleaning means, drive means, and other various equipment known to those of skill in the art that may be commonly used in fibrous structure making machines.

The papermaking belts 164 of the present disclosure can be made, or partially made, according to the process described in U.S. Pat. No. 4,637,859, issued Jan. 20, 1987, to Trokhan, and having the patterns of cells as disclosed herein.

The fibrous web 192 can then be creped with a creping blade 194 to remove the web 192 from the surface of the Yankee dryer 190 resulting in the production of a creped fibrous structure 196 in accordance with the present disclosure. As used herein, creping refers to the reduction in length of a dry (having a consistency of at least about 90% and/or at least about 95%) fibrous web which occurs when energy is applied to the dry fibrous web in such a way that the length of the fibrous web is reduced and the fibers in the fibrous web are rearranged with an accompanying disruption of fiber-fiber bonds. Creping can be accomplished in any of several ways as is well known in the art. The creped fibrous structure 196 is wound on a reel, commonly referred to as a parent roll, and can be subjected to post processing steps such as calendaring, tuft generating operations, embossing, and/or converting. The reel winds the creped fibrous structure at a reel surface velocity, V4.

The papermaking belts of the present disclosure can be utilized to form discrete elements and a substantially continuous network into a fibrous structure during a through-air-drying operation. The discrete elements can be knuckles and can be relatively high density relative to the continuous network, which can be a continuous pillow having a relatively lower density.

As discussed above, the fibrous structure can be embossed during a converting operating to produce the embossed fibrous structures of the present disclosure.

An example of fibrous structures in accordance with the present disclosure can be prepared using a papermaking machine as described above with respect to FIG. 13, and according to the method described below.

A 3% by weight aqueous slurry of northern softwood kraft (NSK) pulp is made up in a conventional re-pulper. The NSK slurry is refined gently and a 2% solution of a permanent wet strength resin (i.e. Kymene 5221 marketed by Hercules incorporated of Wilmington, Del.) is added to the NSK stock pipe at a rate of 1% by weight of the dry fibers. Kymene 5221 is added as a wet strength additive. The adsorption of Kymene 5221 to NSK is enhanced by an in-line mixer. A 1% solution of Carboxy Methyl Cellulose (CMC) (i.e. FinnFix 700 marketed by C.P. Kelco U.S. Inc. of Atlanta, Ga.) is added after the in-line mixer at a rate of 0.2% by weight of the dry fibers to enhance the dry strength of the fibrous substrate. A 3% by weight aqueous slurry of hardwood Eucalyptus fibers is made up in a conventional re-pulper. A 1% solution of defoamer (i.e. BuBreak 4330 marketed by Buckman Labs, Memphis TS) is added to the Eucalyptus stock pipe at a rate of 0.25% by weight of the dry fibers and its adsorption is enhanced by an in-line mixer.

The NSK furnish and the Eucalyptus fibers are combined in the head box and deposited onto a Fourdrinier wire, running at a first velocity $V_1$, homogenously to form an embryonic web. The web is then transferred at the transfer zone from the Fourdrinier forming wire at a fiber consistency of about 15% to the papermaking belt, the papermaking belt moving at a second velocity, $V_2$. The papermaking belt has a pattern of discrete raised portions extending from a reinforcing member, discrete raised portions defining a substantially continuous deflection conduit portion, as described herein, particularly with reference to FIGS. 13A to 16. The transfer occurs in the transfer zone without precipitating substantial densification of the web. The web is then forwarded, at the second velocity, $V_2$, on the papermaking belt along a looped path in contacting relation with a transfer head disposed at the transfer zone, the second velocity being from about 1% to about 40% slower than the first velocity, $V_1$. Since the Fourdrinier wire speed is faster than the papermaking belt, wet shortening, i.e., foreshortening, of the web occurs at the transfer point. In an embodiment the second velocity $V_2$ can be from about 0% to about 5% faster than the first velocity $V_1$.

Further de-watering is accomplished by vacuum assisted drainage until the web has a fiber consistency of about 15% to about 30%. The patterned web is pre-dried by air blow-through, i.e., through-air-drying (TAD), to a fiber consistency of about 65% by weight. The web is then adhered to the surface of a Yankee dryer with a sprayed creping adhesive comprising 0.25% aqueous solution of polyvinyl alcohol (PVA). The fiber consistency is increased to an estimated 95%-97% before dry creping the web with a doctor blade. The doctor blade has a bevel angle of about 45 degrees and is positioned with respect to the Yankee dryer to provide an impact angle of about 101 degrees. This doctor blade position permits the adequate amount of force to be applied to the substrate to remove it off the Yankee while minimally disturbing the previously generated web structure. The dried web is reeled onto a take up roll (known as a parent roll), the surface of the take up roll moving at a fourth velocity, $V_4$, that is faster than the third velocity, $V_3$, of the Yankee dryer. By reeling at a fourth velocity, $V_4$, that is about 1% to 20% faster than the third velocity, $V_3$, some of the foreshortening provided by the creping step is "pulled out," sometimes referred to as a "positive draw," so that the paper can be more stable for any further converting operations.

Two plies of the web can be formed into paper towel products by embossing and laminating them together using PVA adhesive. The paper towel has about 53 g/m$^2$ basis weight and contains 65% by weight Northern Softwood Kraft and 35% by weight Eucalyptus furnish.

The sanitary tissue product is soft, flexible and absorbent.

Another advantage of certain designs of the present invention relate to a problem common in web handling, referred to as "edge curl." When a span of substrate, such as a fibrous substrate of cellulosic tissue is being processed under tension at commercial rates, the edges can rise out of plane in a way that interferes with desired processing. This edge curl is particularly a problem for relatively higher caliper products, such as absorbent tissue substrates for paper towel products.

The inventors have found that one driver of the edge curl phenomenon is the distribution of forces in the web that are transmitted through the continuous feature, such as a continuous knuckle region or a continuous pillow region. In particular, the inventors found that for a substrate web having a caliper of about 23 mils and continuous pillow regions edge curl reduction or elimination can be achieved by ensuring the length of the pillow between any two knuckles measured in the CD direction at any point along the MD direction (i.e., pillow width, PW) is less than about 158 mils (less than about 0.158 inch). For patterns such as the pattern shown in FIG. 5, in which there are spans between rows of knuckles in which the pillow distance is effectively infinite (extending from one edge of the substrate to the other, uninterrupted by a knuckle), the inventors found the mask can be designed such that the entire pattern of knuckles can be rotated at an angle such that X-axis of the pattern is at an angle to the CD sufficiently such that there is no uninterrupted pillow in the CD, and the length of pillow between any two knuckles measured in the CD direction at any point along the MD direction is less than about 158 mils. In an embodiment, the angle of the X-axis with respect to the CD can be from about ±1 degree to about 25 degrees.

Table 2 shows some representative patterns for continuous pillows on a web substrate and the effect of pillow width PW on edge curl. As can be seen, patterns that are designed with relatively short pillow widths PW at zero rotation no edge curl is observed. And patterns that are designed with infinite pillow widths PW at zero rotation can achieve little or no edge curl when rotated to reduce the pillow width to less than about 158 mils.

TABLE 2

Edge Curl Reduction

| Sample | Cell | Min. cell | Rotation | CD PW (mil) | | Edge Curl |
|---|---|---|---|---|---|---|
| Product | count/in^2 | size (mil) | (deg.) | shortest | longest | Reduced |
| In Market | 133 | 42 × 65 | 0 | 49 | Infinite | No |
| Bounty | 133 | 42 × 65 | 25 | 39 | 119 | Yes |
| Embodiment 1 | 160 | 42 × 65 | 4 | 43 | Infinite | No |
| | 160 | 42 × 65 | 18 | 44 | 130 | Yes |
| Embodiment 2 | 133 | 42 × 65 | 0 | 32 | 76 | Yes |
| Embodiment 3 | 155 | approx. 45 × 45 | 25 | 36 | 155 | Yes |
| Embodiment 4 | 141 | 42 × 65 | 3 | 13 | Infinite | No |
| Embodiment 5 | 133 | 42 × 65 | 1 | 47 | 689 | No |
| Embodiment 6 | 150 | 39 × 62 | 18 | 47 | 158 | Yes |

Test Methods

Unless otherwise specified, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. If the sample is in roll form, remove the first 35 to about 50 inches of the sample by unwinding and tearing off via the closest perforation line, if one is present, and discard before testing the sample. All plastic and paper board packaging materials must be carefully removed from the paper samples prior to testing. Discard any damaged product. All tests are conducted in such conditioned room.

Flexural Rigidity Test Method

This test is performed on 1 inch×6 inch (2.54 cm×15.24 cm) strips of a fibrous structure sample. A Cantilever Bending Tester such as described in ASTM Standard D 1388 (Model 5010, Instrument Marketing Services, Fairfield, N.J.) is used and operated at a ramp angle of 41.5±0.5° and a sample slide speed of 0.5±0.2 in/second (1.3±0.5 cm/second). A minimum of n=16 tests are performed on each sample from n=8 sample strips.

No fibrous structure sample which is creased, bent, folded, perforated, or in any other way weakened should ever be tested using this test. A non-creased, non-bent, non-folded, non-perforated, and non-weakened in any other way fibrous structure sample should be used for testing under this test.

From one fibrous structure sample of about 4 inch×6 inch (10.16 cm×15.24 cm), carefully cut using a 1 inch (2.54 cm) JDC Cutter (available from Thwing-Albert Instrument Company, Philadelphia, Pa.) four (4) 1 inch (2.54 cm) wide by 6 inch (15.24 cm) long strips of the fibrous structure in the MD direction. From a second fibrous structure sample from the same sample set, carefully cut four (4) 1 inch (2.54 cm) wide by 6 inch (15.24 cm) long strips of the fibrous structure in the CD direction. It is important that the cut be exactly perpendicular to the long dimension of the strip. In cutting non-laminated two-ply fibrous structure strips, the strips should be cut individually. The strip should also be free of wrinkles or excessive mechanical manipulation which can impact flexibility. Mark the direction very lightly on one end of the strip, keeping the same surface of the sample up for all strips. Later, the strips will be turned over for testing, thus it is important that one surface of the strip be clearly identified, however, it makes no difference which surface of the sample is designated as the upper surface.

Using other portions of the fibrous structure (not the cut strips), determine the basis weight of the fibrous structure sample in lbs/3000 $ft^2$ and the caliper of the fibrous structure in mils (thousandths of an inch) using the standard procedures disclosed herein. Place the Cantilever Bending Tester level on a bench or table that is relatively free of vibration, excessive heat and most importantly air drafts. Adjust the platform of the Tester to horizontal as indicated by the leveling bubble and verify that the ramp angle is at 41.5±0.5°. Remove the sample slide bar from the top of the platform of the Tester. Place one of the strips on the horizontal platform using care to align the strip parallel with the movable sample slide. Align the strip exactly even with the vertical edge of the Tester wherein the angular ramp is attached or where the zero mark line is scribed on the Tester. Carefully place the sample slide bar back on top of the sample strip in the Tester. The sample slide bar must be carefully placed so that the strip is not wrinkled or moved from its initial position.

Move the strip and movable sample slide at a rate of approximately 0.5±0.2 in/second (1.3±0.5 cm/second) toward the end of the Tester to which the angular ramp is attached. This can be accomplished with either a manual or automatic Tester. Ensure that no slippage between the strip and movable sample slide occurs. As the sample slide bar and strip project over the edge of the Tester, the strip will begin to bend, or drape downward. Stop moving the sample slide bar the instant the leading edge of the strip falls level with the ramp edge. Read and record the overhang length from the linear scale to the nearest 0.5 mm. Record the distance the sample slide bar has moved in cm as overhang length. This test sequence is performed a total of eight (8) times for each fibrous structure in each direction (MD and CD). The first four strips are tested with the upper surface as the fibrous structure was cut facing up. The last four strips are inverted so that the upper surface as the fibrous structure was cut is facing down as the strip is placed on the horizontal platform of the Tester.

The average overhang length is determined by averaging the sixteen (16) readings obtained on a fibrous structure.

$$\text{Overhang Length } MD = \frac{\text{Sum of 8 } MD \text{ readings}}{8}$$

$$\text{Overhang Length } CD = \frac{\text{Sum of 8 } CD \text{ readings}}{8}$$

$$\text{Overhang Length Total} = \frac{\text{Sum of all 16 readings}}{16}$$

$$\text{Bend Length } MD = \frac{\text{Overhang Length } MD}{2}$$

$$\text{Bend Length } CD = \frac{\text{Overhang Length } CD}{2}$$

$$\text{Bend Length Total} = \frac{\text{Overhang Length Total}}{2}$$

$$\text{Flexural Rigidity} = 0.1629 \times W \times C^3$$

wherein W is the basis weight of the fibrous structure in lbs/3000 $ft^2$; C is the bending length (MD or CD or Total) in cm; and the constant 0.1629 is used to convert the basis weight from English to metric units. The results are expressed in mg*$cm^2$/cm (or alternatively mg*cm).

GM Flexural Rigidity=Square root of (MD Flexural Rigidity×CD Flexural Rigidity).

Basis Weight Test Method

Basis weight of a fibrous structure sample is measured by selecting twelve (12) usable units (also referred to as sheets) of the fibrous structure and making two stacks of six (6) usable units each. Perforation must be aligned on the same side when stacking the usable units. A precision cutter is used to cut each stack into exactly 8.89 cm×8.89 cm (3.5 in.×3.5 in.) squares. The two stacks of cut squares are combined to make a basis weight pad of twelve (12) squares thick. The basis weight pad is then weighed on a top loading balance with a minimum resolution of 0.01 g. The top loading balance must be protected from air drafts and other disturbances using a draft shield. Weights are recorded when the readings on the top loading balance become constant. The Basis Weight is calculated as follows:

$$\text{Basis Weight (lbs/3000 ft}^2) = \frac{\text{Weight of basis weight pad (g)} \times 3000 \text{ ft}^2}{453.6 \text{ g/lbs} \times 12(\text{usable units}) \times [12.25 \text{ in}^2(\text{Area of basis weight pad})/144 \text{ in}^2]}$$

$$\text{Basis Weight (g/m}^2 \text{ or gsm)} = \frac{\text{Weight of basis weight pad (g)} \times 10{,}000 \text{ cm}^2/\text{m}^2}{79.0321 \text{ cm}^2(\text{Area of basis weight pad}) \times 12(\text{usable units})}$$

Caliper Test Method

Caliper of a fibrous structure is measured by cutting five (5) samples of fibrous structure such that each cut sample is larger in size than a load foot loading surface of a VIR Electronic Thickness Tester Model II available from Thwing-Albert Instrument Company, Philadelphia, Pa. Typically, the load foot loading surface has a circular surface area of about 3.14 $in^2$. The sample is confined between a horizontal flat surface and the load foot loading surface. The load foot loading surface applies a confining pressure to the sample of 95 $g/in^2$. The caliper of each sample is the resulting gap between the flat surface and the load foot loading surface. The caliper is calculated as the average caliper of the five samples. The result is reported in thousandths of an inch (mils).

Elongation, Tensile Strength, TEA and Modulus Test Methods

Remove four (4) usable units (also referred to as sheets) of fibrous structures and stack one on top of the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co. of Philadelphia, Pa.) to make 4 separate stacks. Make sure stacks 1 and 3 are still identified for machine direction testing and stacks 2 and 4 are identified for cross direction testing.

Cut two 1 inch (2.54 cm) wide strips in the machine direction from stacks 1 and 3. Cut two 1 inch (2.54 cm) wide strips in the cross direction from stacks 2 and 4. There are now four 1 inch (2.54 cm) wide strips for machine direction tensile testing and four 1 inch (2.54 cm) wide strips for cross direction tensile testing.

For the actual measurement of the elongation, tensile strength, TEA and modulus, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min (10.16 cm/min) and the gauge length to 4.00 inches (10.16 cm). The break sensitivity is set to 20.0 grams and the sample width is set to 1.00 inch (2.54 cm) and the sample thickness is set to 0.3937 inch (1 cm). The energy units are set to TEA and the tangent modulus (Modulus) trap setting is set to 38.1 g.

Take one of the fibrous structure sample strips and place one end of it in one clamp of the tensile tester. Place the other end of the fibrous structure sample strip in the other clamp. Make sure the long dimension of the fibrous structure sample strip is running parallel to the sides of the tensile tester. Also make sure the fibrous structure sample strips are not overhanging to the either side of the two clamps. In addition, the pressure of each of the clamps must be in full contact with the fibrous structure sample strip.

After inserting the fibrous structure sample strip into the two clamps, the instrument tension can be monitored. If it shows a value of 5 grams or more, the fibrous structure sample strip is too taut. Conversely, if a period of 2-3 seconds passes after starting the test before any value is recorded, the fibrous structure sample strip is too slack.

Start the tensile tester as described in the tensile tester instrument manual. The test is complete after the crosshead automatically returns to its initial starting position. When the test is complete, read and record the following with units of measure:

Peak Load Tensile (Tensile Strength) (g/in)
Peak Elongation (Elongation) (%)
Peak TEA (TEA) (in-$g/in^2$)
Tangent Modulus (Modulus) (at 15 g/cm)

Test each of the samples in the same manner, recording the above measured values from each test.

Calculations:

Geometric Mean (GM) Elongation=Square Root of [MD Elongation (%)×CD Elongation (%)]

Total Dry Tensile (TDT)=Peak Load MD Tensile (g/in)+Peak Load CD Tensile (g/in)

Tensile Ratio=Peak Load MD Tensile (g/in)/Peak Load CD Tensile (g/in)

Geometric Mean (GM) Tensile=[Square Root of (Peak Load MD Tensile (g/in)×Peak Load CD Tensile (g/in))]×3

TEA=MD TEA (in-$g/in^2$)+CD TEA (in-$g/in^2$)

Geometric Mean (GM) TEA=Square Root of [MD TEA (in-$g/in^2$)×CD TEA (in-$g/in^2$)]

Modulus=MD Modulus (at 15 g/cm)+CD Modulus (at 15 g/cm)

Geometric Mean (GM) Modulus=Square Root of [MD Modulus (at 15 g/cm)×CD Modulus (at 15 g/cm)]

Tensile Tester Settings for a 5000 gram load cell (Settings shown for English units) EJA 1000/EJA 2000

| Setting/ Product | Units | Tissue/ Napkins | Facials | Towels |
|---|---|---|---|---|
| Set Mode | | Tension | Tension | Tension |
| English/Metric | | English | English | English |
| Curve Units | | load/elong | load/elong | load/elong |
| Energy Units | | TEA | TEA | TEA |
| Elongation Units | | ins | ins | ins |
| Load Units | | gms | gms | gms |
| Test Over | | Fail | Fail | Fail |
| Set Range | | 100% | 100% | 100% |
| At Test End | | Return | Return | Return |
| Pre/Test Speed | ins/min | 4.00 | 6.00 | 4.00 |
| Test Speed | ins/min | 4.00 | 6.00 | 4.00 |
| Start of Test Speed | ins/min | 4.00 | 6.00 | 4.00 |
| Start of Test Distance | ins | 0.1 | 0.1 | 0.1 |
| Post-Change Speed | ins/min | 4.00 | 6.00 | 4.00 |
| Return Speed | ins/min | 20 or 40 | 20 or 40 | 20 or 40 |
| Sampling Rate | | 20 | 20 | 20 |
| Chart Device | | | | |
| Collision | | yes | yes | yes |
| 1st Gauge Length | ins | — | — | — |
| 2nd Gauge Length | ins | — | — | — |
| Gauge Length | ins | 2.00 | 4.00 | 4.00 |
| Adj. Gauge Length | | Adj. | Adj. | Adj. |
| Break Sensitivity | gms | 20 | 20 | 20 |
| Pretension* | | 11.12/ 2.22/1.39 | 11.12/1.39 | 11.12 |
| Sample Size | | — | — | — |
| Load divider | | Table 1 | Table 1 | Table 1 |
| Sample Shape | | Rectangle | Rectangle | Rectangle |
| Sample Width | ins | 1.00 | 1.00 | 1.00 |

-continued

| Setting/ Product | Units | Tissue/ Napkins | Facials | Towels |
|---|---|---|---|---|
| Sample Thickness | ins | 0.3937 | 0.3937 | 0.3937 |
| Set Start Load | | 0 | 0 | 0 |
| Set Zero Load | | 0.05 | 0.05 | 0.05 |

SST Absorbency Rate

This test incorporates the Slope of the Square Root of Time (SST) Test Method.

The SST method measures rate over a wide spectrum of time to capture a view of the product pick-up rate over the useful lifetime. In particular, the method measures the absorbency rate via the slope of the mass versus the square root of time from 2-15 seconds.

Overview

The absorption (wicking) of water by a fibrous sample is measured over time. A sample is placed horizontally in the instrument and is supported by an open weave net structure that rests on a balance. The test is initiated when a tube connected to a water reservoir is raised and the meniscus makes contact with the center of the sample from beneath, at a small negative pressure. Absorption is controlled by the ability of the sample to pull the water from the instrument for approximately 20 seconds. Rate is determined as the slope of the regression line of the outputted weight vs sqrt(time) from 2 to 15 seconds.

Apparatus

Conditioned Room—Temperature is controlled from 73° F.±2° F. (23° C.±1° C.). Relative Humidity is controlled from 50%±2%

Sample Preparation—Product samples are cut using hydraulic/pneumatic precision cutter into 3.375 inch diameter circles.

Capacity Rate Tester (CRT)—The CRT is an absorbency tester capable of measuring capacity and rate. The CRT consists of a balance (0.001 g), on which rests on a woven grid (using nylon monofilament line having a 0.014" diameter) placed over a small reservoir with a delivery tube in the center. This reservoir is filled by the action of solenoid valves, which help to connect the sample supply reservoir to an intermediate reservoir, the water level of which is monitored by an optical sensor. The CRT is run with a−2 mm water column, controlled by adjusting the height of water in the supply reservoir.

Software—LabView based custom software specific to CRT Version 4.2 or later.

Water—Distilled water with conductivity<10 μS/cm (target<5 μS/cm)@ 25° C.

Sample Preparation

For this method, a usable unit is described as one finished product unit regardless of the number of plies. Condition all samples with packaging materials removed for a minimum of 2 hours prior to testing. Discard at least the first ten usable units from the roll. Remove two usable units and cut one 3.375-inch circular sample from the center of each usable unit for a total of 2 replicates for each test result. Do not test samples with defects such as wrinkles, tears, holes, etc. Replace with another usable unit which is free of such defects Sample Testing Pre-Test Set-Up 1. The water height in the reservoir tank is set −2.0 mm below the top of the support rack (where the towel sample will be placed).
2. The supply tube (8 mm I.D.) is centered with respect to the support net.
3. Test samples are cut into circles of 3⅜" diameter and equilibrated at Tappi environment conditions for a minimum of 2 hours.

Test Description

1. After pressing the start button on the software application, the supply tube moves to 0.33 mm below the water height in the reserve tank. This creates a small meniscus of water above the supply tube to ensure test initiation. A valve between the tank and the supply tube closes, and the scale is zeroed.
2. The software prompts you to "load a sample". A sample is placed on the support net, centering it over the supply tube, and with the side facing the outside of the roll placed downward.
3. Close the balance windows, and press the "OK" button—the software records the dry weight of the circle.
4. The software prompts you to "place cover on sample". The plastic cover is placed on top of the sample, on top of the support net. The plastic cover has a center pin (which is flush with the outside rim) to ensure that the sample is in the proper position to establish hydraulic connection. Four other pins, 1 mm shorter in depth, are positioned 1.25-1.5 inches radially away from the center pin to ensure the sample is flat during the test. The sample cover rim should not contact the sheet. Close the top balance window and click "OK".
5. The software re-zeroes the scale and then moves the supply tube towards the sample. When the supply tube reaches its destination, which is 0.33 mm below the support net, the valve opens (i.e., the valve between the reserve tank and the supply tube), and hydraulic connection is established between the supply tube and the sample. Data acquisition occurs at a rate of 5 Hz, and is started about 0.4 seconds before water contacts the sample.
6. The test runs for at least 20 seconds. After this, the supply tube pulls away from the sample to break the hydraulic connection.
7. The wet sample is removed from the support net. Residual water on the support net and cover are dried with a paper towel.
8. Repeat until all samples are tested.
9. After each test is run, a *.txt file is created (typically stored in the CRT/data/rate directory) with a file name as typed at the start of the test. The file contains all the test set-up parameters, dry sample weight, and cumulative water absorbed (g) vs. time (sec) data collected from the test.

Calculation of Rate of Uptake

Take the raw data file that includes time and weight data.

First, create a new time column that subtracts 0.4 seconds from the raw time data to adjust the raw time data to correspond to when initiation actually occurs (about 0.4 seconds after data collection begins).

Second, create a column of data that converts the adjusted time data to square root of time data (e.g., using a formula such as SQRT( ) within Excel).

Third, calculate the slope of the weight data vs the square root of time data (e.g., using the SLOPE( ) function within Excel, using the weight data as the y-data and the sqrt(time) data as the x-data, etc.). The slope should be calculated for the data points from 2 to 15 seconds, inclusive (or 1.41 to 3.87 in the sqrt(time) data column).

Calculation of Slope of the Square Root of Time (SST)

The start time of water contact with the sample is estimated to be 0.4 seconds after the start of hydraulic connection is established between the supply tube and the sample (CRT Time). This is because data acquisition begins while the tube is still moving towards the sample, and incorporates the small delay in scale response. Thus, "time zero" is actually at 0.4 seconds in CRT Time as recorded in the *.txt file.

The slope of the square root of time (SST) from 2-15 seconds is calculated from the slope of a linear regression line from the square root of time between (and including) 2 to 15 seconds (x-axis) versus the cumulative grams of water absorbed. The units are $g/sec^{0.5}$.

Reporting Results

Report the average slope to the nearest 0.01 $g/s^{0.5}$.

Percent Compressibility Test Method

Figure 14:
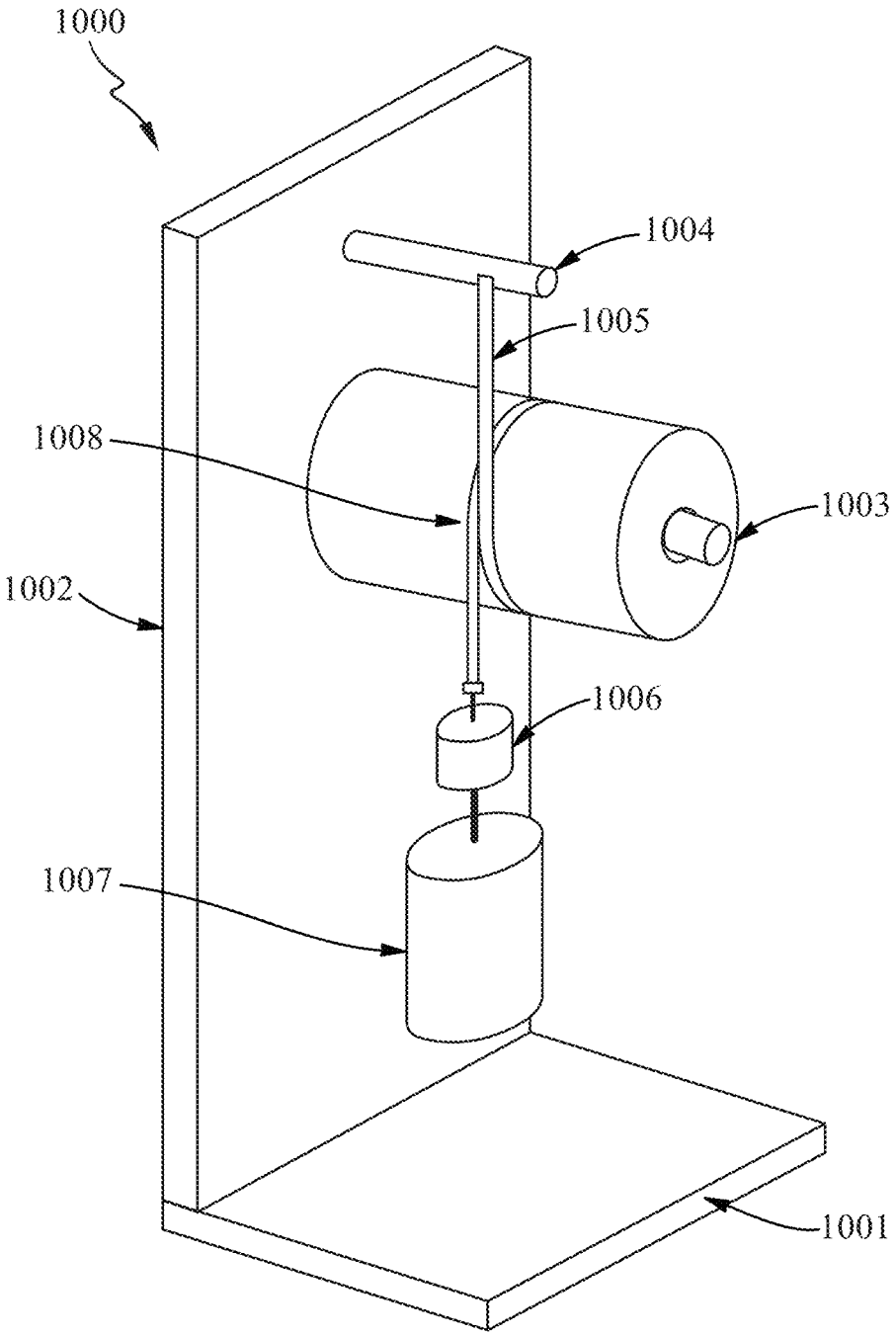
FIG. 14 is a perspective view of a test stand for measuring roll compressibility properties.

Percent Roll Compressibility (Percent Compressibility) is determined using the Roll Diameter Tester 1000 as shown in FIG. 14. It is comprised of a support stand made of two aluminum plates, a base plate 1001 and a vertical plate 1002 mounted perpendicular to the base, a sample shaft 1003 to mount the test roll, and a bar 1004 used to suspend a precision diameter tape 1005 that wraps around the circumference of the test roll. Two different weights 1006 and 1007 are suspended from the diameter tape to apply a confining force during the uncompressed and compressed measurement. All testing is performed in a conditioned room maintained at about 23° C.±2 C.° and about 50%±2% relative humidity.

The diameter of the test roll is measured directly using a Pi® tape or equivalent precision diameter tape (e.g. an Executive Diameter tape available from Apex Tool Group, LLC, Apex, N.C., Model No. W606PD) which converts the circumferential distance into a diameter measurement so the roll diameter is directly read from the scale. The diameter tape is graduated to 0.01 inch increments with accuracy certified to 0.001 inch and traceable to NIST. The tape is 0.25 in wide and is made of flexible metal that conforms to the curvature of the test roll but is not to elongated under the 1100 g loading used for this test. If necessary the diameter tape is shortened from its original length to a length that allows both of the attached weights to hang freely during the test, yet is still long enough to wrap completely around the test roll being measured. The cut end of the tape is modified to allow for hanging of a weight (e.g. a loop). All weights used are calibrated, Class F hooked weights, traceable to NIST.

The aluminum support stand is approximately 600 mm tall and stable enough to support the test roll horizontally throughout the test. The sample shaft 1003 is a smooth aluminum cylinder that is mounted perpendicularly to the vertical plate 1002 approximately 485 mm from the base. The shaft has a diameter that is at least 90% of the inner diameter of the roll and longer than the width of the roll. A small steel bar 1004 approximately 6.3 mm diameter is mounted perpendicular to the vertical plate 1002 approximately 570 mm from the base and vertically aligned with the sample shaft. The diameter tape is suspended from a point along the length of the bar corresponding to the midpoint of a mounted test roll. The height of the tape is adjusted such that the zero mark is vertically aligned with the horizontal midline of the sample shaft when a test roll is not present.

Condition the samples at about 23° C.±2 C.° and about 50%±2% relative humidity for 2 hours prior to testing. Rolls with cores that are crushed, bent or damaged should not be tested. Place the test roll on the sample shaft 1003 such that the direction the paper was rolled onto its core is the same direction the diameter tape will be wrapped around the test roll. Align the midpoint of the roll's width with the suspended diameter tape. Loosely loop the diameter tape 1004 around the circumference of the roll, placing the tape edges directly adjacent to each other with the surface of the tape lying flat against the test sample. Carefully, without applying any additional force, hang the 100 g weight 1006 from the free end of the tape, letting the weighted end hang freely without swinging. Wait 3 seconds. At the intersection of the diameter tape 1008, read the diameter aligned with the zero mark of the diameter tape and record as the Original Roll Diameter to the nearest 0.01 inches. With the diameter tape still in place, and without any undue delay, carefully hang the 1000 g weight 1007 from the bottom of the 100 g weight, for a total weight of 1100 g. Wait 3 seconds. Again read the roll diameter from the tape and record as the Compressed Roll Diameter to the nearest 0.01 inch. Calculate percent compressibility to the according to the following equation and record to the nearest 0.1%:

$$\%\ \text{Compressibility} = \frac{(\text{Orginal Roll Diameter}) - (\text{Compressed Roll Diameter})}{\text{Original Roll Diameter}} \times 100$$

Repeat the testing on 10 replicate rolls and record the separate results to the nearest 0.1%. Average the 10 results and report as the Percent Compressibility to the nearest 0.1%.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

What is claimed is:

1. A fibrous structure, comprising:

a plurality of discrete wet-formed knuckles arranged in a pattern of repeat units in an X-Y coordinate plane, and characterized by:

each of the discrete wet-formed knuckles within the repeat unit have substantially the same shape, at least two of the plurality of discrete wet-formed knuckles within the repeat unit have varying size; and wherein at least some of the discrete wet-formed knuckles are arranged in a plurality of rows of adjacent wet-formed knuckles, the rows separated in a Y-direction by a distance of between 0.020 inch and 0.200 inch, and including at least a first row and a second row, with an X-direction distance between at least two adjacent discrete wet-formed knuckles in the first row being different than the X-direction distance between at least two adjacent discrete wet-formed knuckles in the second row, the X-direction distance being between 0.010 inch and 0.100 inch.

2. The fibrous structure of claim 1, wherein all of the discrete wet-formed knuckles are in one of the plurality of rows.

3. The fibrous structure of claim 1, wherein the fibrous structure comprises two plies.

4. The fibrous structure of claim 1, wherein the fibrous structure is embossed.

5. The fibrous structure of claim 1, wherein the fibrous structure is creped.

6. The fibrous structure of claim 1, wherein the fibrous structure is through air dried.

7. The fibrous structure of claim 1, wherein the fibrous structure is one of a paper towel or bath tissue.

* * * * *